US005909083A

United States Patent [19]

Asano et al.

[11] Patent Number: 5,909,083

[45] Date of Patent: Jun. 1, 1999

[54] PROCESS FOR PRODUCING PLASMA DISPLAY PANEL

[75] Inventors: Masaaki Asano; Satoru Kuramochi; Yozo Kosaka, all of Tokyo-to, Japan

[73] Assignee: Dai Nippon Printing Co., Ltd., Japan

[21] Appl. No.: 08/801,859

[22] Filed: Feb. 18, 1997

[30] Foreign Application Priority Data

| | | | |
|---|---|---|---|
| Feb. 16, 1996 | [JP] | Japan | 8-052549 |
| Mar. 7, 1996 | [JP] | Japan | 8-079458 |
| May 22, 1996 | [JP] | Japan | 8-126711 |

[51] Int. Cl.[6] ..... H01J 17/49

[52] U.S. Cl. ..... 313/584; 430/198; 430/323; 451/30; 451/31; 264/614; 264/619; 264/642; 264/678; 445/24

[58] Field of Search ..... 430/198, 321, 430/322, 323; 451/30, 31; 264/139, 614, 619, 642, 678; 445/24; 313/584, 585, 586, 587

[56] References Cited

U.S. PATENT DOCUMENTS

| | | | |
|---|---|---|---|
| 5,541,479 | 7/1996 | Nagakubo | 313/584 |
| 5,624,782 | 4/1997 | Hayakawa et al. | 430/198 |
| 5,757,131 | 5/1998 | Tsuchiya | 313/584 |

*Primary Examiner*—Kenneth J. Ramsey
*Attorney, Agent, or Firm*—Parkhurst & Wendel, L.L.P.

[57] ABSTRACT

A process for producing a plasma display panel, involving the formation of a predetermined pattern for a plasma display panel, including an electrode pattern and a barrier for defining a discharge space, said process comprising the steps of:

forming a predetermined pattern-forming material layer on a substrate;

forming a mask pattern, comprising a main component of the material layer, on the pattern-forming material layer:

etching the pattern-forming material layer with the mask pattern formed thereon, thereby patterning the pattern-forming material layer; and then firing the pattern-forming material layer with the mask pattern provided thereon and the mask layer, thereby integrating the pattern-forming material layer and at least part of the mask layer with each other.

32 Claims, 9 Drawing Sheets

PROCESS FOR PRODUCING PLASMA DISPLAY PANEL

BACKGROUND OF THE INVENTION

The present invention relates to a process for producing a plasma display panel (PDP).

According to the production process of the present invention, a pattern of a barrier for defining a discharge space, an electrode, a resistor, a dielectric layer or the like can be easily and uniformly formed by sandblasting. The plasma display panel according to the present invention is excellent in uniformity of in-plane brightness by virtue of a high-definition, uniform barrier structure. Further, since the barrier layer is colored, it is possible to improve the contrast and to improve the luminescence brightness of the phosphor.

PDP generally comprises: two opposed glass substrates; a pair of electrodes systematically arranged in the glass substrates; and a gas (mainly neon, xenon or the like) sealed therebetween. A voltage is applied across the electrodes to produce discharge within minute cells around the electrodes to emit light from each cell, thereby displaying information. In particular, systematically arranged cells are selectively subjected to discharge luminescence in order to display information.

Such PDPs are classified into two types, a direct current type (DC type) PDP, wherein electrodes are exposed to a discharge space, and an alternating current type (AC type) wherein electrodes are covered with an insulating layer. Each of these types is further classified into a refresh drive system and a memory drive system according to display functions and drive systems.

FIGS. 3 and 4 are a diagram showing a general construction of AC type PDP.

This AC type PDP is a plane discharge type PDP having a three electrode structure. FIG. 3 is a perspective view of the AC type PDP, and FIG. 4 a cross-sectional view of the AC type PDP in a plane parallel to a barrier. In these drawings, a glass substrate 12 as a front plate is shown separately from a glass substrate 11 as a back plate. As shown in the drawings, the glass substrates 12 and 11 are provided parallel and opposite to each other, and a barrier 8 stands on and is fixed to the front surface side of the glass substrate 11. This barrier 8 serves to hold the glass substrate 11 and the glass substrate 12 while leaving a given space between these substrates. Display electrodes X comprised of an electrode 14 of a transparent conductive layer and a bus electrode 15, which overlaps with the electrode 14, are provided in parallel to each other on the back surface side of the glass substrate 12, and a dielectric layer 16, covering the display electrodes X, and an MgO layer 17 are further provided.

On the other hand, on the front surface side of the glass substrate 11 are provided address electrodes Y orthogonal to the display electrodes X and a dielectric layer covering the address electrodes. Further, barriers 8 in a stripe form are provided parallel to each other or one another on the address electrodes Y, and a phosphor layer 19 having a predetermined luminescent color is provided so as to cover the wall surface of the barrier 8 and the bottom of the cell.

Each barrier is disposed between adjacent two electrodes Y so as to divide the discharge space in the line direction for each luminescent region.

In this AC type PDP, a predetermined voltage is applied, from an alternating current source, across the composite electrodes on the glass substrate 12 as the front plate to create an electric field, producing discharge within each cell as a display element defined by the glass substrate 12, the glass substrate 11 as the back plate, and the barrier 8. Ultraviolet light produced by the discharge permits the phosphor layer 19 to emit light, and light transmitted through the glass substrate 12 is viewed by an observer.

A conventional method for the formation of a barrier for PDP comprises conducting, once or a plurality of time, the step of printing a barrier-forming material on a substrate so as to correspond to the shape of a barrier pattern and drying the print to obtain a desired height.

Another conventional method for the formation of a barrier for PDP comprises the steps of: coating a barrier-forming material on the whole surface of a substrate; patterning a resist, possessing sandblasting resistance, in a predetermined form on the coating; performing sandblasting to remove areas not protected by the resist; and then separating and removing the resist (see Japanese Patent Publication No. 58438/1992).

Pattern formation by screen printing raises the following various problems. Firstly, stretching of a screen used in the printing is unavoidable, and, hence, misregistration between the screen and the electrode is likely to occur. Secondly, since a screen is used in the plate, distortion of the pattern is likely to occur, making it difficult to form a fine pattern. Thirdly, the barrier-forming material is travelled toward the backside of the screen plate, requiring wiping each time and the like. This makes it difficult to automate the pattern formation. Fourthly, the dimension of the finest pattern which can be formed by the screen printing is about 100 $\mu$m in width, and the shape of the pattern is such that the ratio of the half-value width to the bottom width (half-value width/bottom width) is about 0.5. Therefore, a large bottom area is necessary for forming a pattern having a large height, posing a problem that no definite pattern can be formed.

The term "half-value width" used herein refers to the width of a stripe pattern or the like in the position of the half of the height of the stripe pattern (barrier) or the like.

In order to avoid the above problem, a method not relying on the screen printing is considered wherein a low-melting glass paste as a barrier-forming material is coated all over the surface of a glass substrate so as to uniformly cover the glass substrate to form a layer which is then partially cut out with the aid of sandblast. This method is called "sandblasting."

In this case, uniform coating of the glass paste followed by firing at such a temperature that the glass frit is completely fused, renders the cutting remarkably difficult. On the other hand, when firing is performed at such a temperature that the resin component is burned off and the fusing of the glass does not occur, the cutting rate is so high that control of the cutting is difficult. In this case, therefore, cutting of the coating in a paste state before firing is advantageous. In the case of cutting of a glass paste before firing, selection of the content and kind of the binder so as to provide a high cutting rate results in deteriorated adhesion between the cutting mask of a photosensitive resist material and the glass paste layer and, hence, creates separation of the cutting mask, making it impossible to form a barrier having a contemplated shape. On the other hand, selection of the content and kind of the binder so as to provide high adhesion results in separation of the glass paste material together with the cutting mask at the time of separation and removal of the cutting mask after the cutting due to good adhesion between the cutting mask and the glass paste layer, posing a problem that the shape of the top of the barrier is broken.

In the above method using a cutting mask, a dry film, for example, is used as the resist. In this case, a process involving the step of application of a dry film, the step of exposure, the step of development, the step of blasting, and the step of separation of the dry film is necessary. This process is long and troublesome.

The present invention has been made with a view to solving the above problems, and an object of the present invention is to provide a process for producing a plasma display panel which enables a high-definition, large plasma display panel having a pattern possessing a uniform shape to be produced in a simple and efficient manner.

Further, in the present invention, the use of different colors for respective layers constituting the barrier results in enhanced brightness and improved contrast of the display.

DISCLOSURE OF THE INVENTION

According to the present invention, there is provided a process for producing a plasma display panel, involving the formation of a predetermined pattern, for a plasma display panel, including an electrode pattern and a barrier for defining a discharge space, said process comprising the steps of:

forming a predetermined pattern-forming material layer on a substrate;

forming a mask pattern, comprising a main component of the pattern-forming material layer, on the pattern-forming material layer:

etching the pattern-forming material layer with the mask pattern formed thereon, thereby patterning the pattern-forming material layer; and then firing the pattern-forming material layer, with the mask pattern provided thereon, and the mask layer, thereby integrating the pattern-forming material layer and at least part of the mask layer with each other.

In the first aspect of the present invention, the material for the mask pattern further comprises an ionizing radiation curing resin and the process comprises the step of patterning the material layer for the mask by photolithography to form the mask pattern.

In the second aspect of the present invention, the process comprises the step of forming the mask pattern by printing.

In the third aspect of the present invention, the process comprises the step of forming the mask pattern by transfer or the like.

BEST MODE FOR CARRYING OUT THE INVENTION

First aspect

Figure 1A:
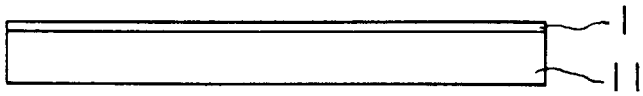
FIGS. 1A to 1F, FIGS. 2A to 2G, FIGS. 5A to 5D, FIGS. 6A and 6B, FIGS. 7A to 7G, FIGS. 8A to 8F, and FIGS. 9A to 9E are each a process diagram showing a process for producing the plasma display panel according to the present invention.

According to a specific embodiment of the production process according to the first invention, for example, in the production of a plasma display panel, involving the formation of a barrier for defining a discharge space by sandblasting, the process comprises the steps of: coating a first barrier-forming material comprising at least a low-melting glass frit and a binder resin on the inner surface of one of two parallel opposed insulating substrates and drying the coating, this step being conducted once or repeated a plurality of times, thereby forming a first barrier-forming material layer having a required height; coating a second barrier-forming material comprising at least a low-melting glass frit and an ionizing radiation-curable resin, the proportion of the ionizing radiation-curable resin being 5 to 150 parts by weight based on 100 parts by weight of the low-melting glass frit, on the first barrier-forming material layer, to a required height and drying the coating to form a second barrier-forming material layer; applying an ionizing radiation through a photomask to the second barrier-forming material layer in its areas where a barrier pattern is to be formed, and developing the exposed second barrier-forming material layer to form a barrier pattern; cutting the first barrier-forming material layer by sandblasting using, as a cutting mask, the second barrier-forming material layer with a barrier pattern formed thereon; and firing the first barrier-forming material layer and the second barrier-forming material layer to form a barrier composed of a first barrier layer and a second barrier layer.

In this process for producing a plasma display panel, a mask is formed using a photosensitive barrier-forming material instead of the conventional cutting mask formed of a photosensitive cutting resist, eliminating the need to provide the step of separating and removing the cutting mask after sandblasting. This enables the formation of a barrier having a uniform shape, which has been difficult in the prior art, and, in addition, enables a high-definition, large plasma display panel to be easily produced.

The subject matter of the process for producing a plasma display panel according to the second embodiment of the present invention resides in a process for producing a plasma display panel, involving the formation of a barrier for defining a discharge space by sandblasting, the process comprises the steps of: coating a first barrier-forming material comprising at least a low-melting glass frit and a binder resin on the inner surface of one of two parallel opposed insulating substrates and drying the coating, this step being conducted once or repeated a plurality of times, thereby forming a first barrier-forming material layer having a required height; coating a third barrier-forming material comprising at least a low-melting glass frit and a binder resin on the first barrier-forming material layer to a required height and drying the coating to form a third barrier-forming material layer; coating a second barrier-forming material comprising at least a low-melting glass frit and an ionizing radiation-curable resin, the proportion of the ionizing radiation-curable resin being 5 to 150 parts by weight based on 100 parts by weight of the low-melting glass frit, on the third barrier-forming material layer to a required height and drying the coating to form a second barrier-forming material layer; applying an ionizing radiation through a photomask to the second barrier-forming material layer in its areas where a barrier pattern is to be formed, and developing the exposed second barrier-forming material layer to form a barrier pattern; cutting the first barrier-forming material layer and the third barrier-forming material layer by sandblasting using as a cutting mask the second barrier-forming material layer having a barrier pattern; and firing the first barrier-forming material layer, the third barrier-forming material layer, and the second barrier-forming material layer to form a barrier composed of a first barrier layer, a third barrier layer, and a second barrier layer.

In this process for producing a plasma display panel, provision of a barrier-forming material layer having a three-layer structure of first and second barrier-forming material layers and a third barrier-forming material layer for enhancing the strength of bond between the first and second barrier-forming material layers offers excellent adhesion of the photosensitized cutting mask layer to the barrier-forming material layer and can render the shape of the barrier more uniform.

A further embodiment of the present invention resides in a plasma display panel comprising a barrier for defining a discharge space, said barrier being provided on the inner surface of one of two parallel opposed insulting substrates, wherein the barrier comprises a laminate of first, second, and third layers each formed of a sinter composed mainly of a low-melting glass, the first layer provided on the insulating substrate side is colored with a bright color pigment, the third layer provided between the first layer and the second layer is colored with a dark color pigment and the second layer as a surface layer through which light emerges is permeable to light.

In this plasma display panel, the barrier has a three-layer structure, wherein the second layer is transparent due to its inherent photosensitive nature, the third layer has a dark color, and the first layer has a bright color. This constitution can simultaneously improve the contrast and the luminescence brightness of the phosphor without sacrificing the photosensitivity of the second layer.

The above embodiments will be described with reference to the accompanying drawings.

FIG. 1 is a diagram showing, in the order of steps, the process for producing a plasma display panel according to the present invention.

At the outset, if necessary, a thin primer layer 1 of a low-melting glass is formed on a glass substrate 11 (FIG. 1A). The provision of the primer layer is preferred from the viewpoint of preventing an alkali component or the like being diffused from the glass substrate or of improving the adhesion to the substrate in the formation of an electrode, a dielectric and a barrier.

Figure 1B:
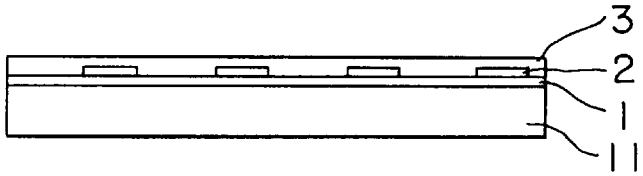

An address electrode 2 is formed thereon using a paste material, for an electrode, comprised of a metal, such as Ag, Ni, or Cu, or an alloy of these metals dispersed in a low-melting glass frit or a binder resin, which can be fired at a low temperature, by screen printing, photolithography, filling, sandblasting or the like, and, if necessary, a dielectric layer 3 comprising a low-melting glass is formed (FIG. 1B). The provision of the dielectric layer is preferred from the viewpoints of stability at the time of driving and, in addition, of preventing the electrode being exposed in order to avoid damage to the electrode at the time of formation of the barrier by sandblasting.

The material for the dielectric layer is preferably a lead oxide glass or a low-melting glass composed mainly of bismuth oxide.

Figure 1C:
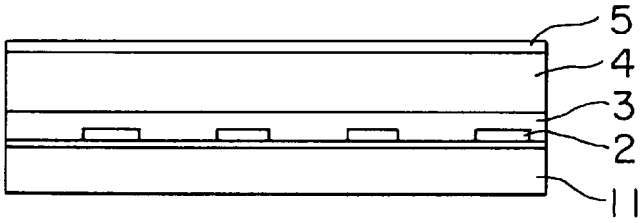
Figure 1D:
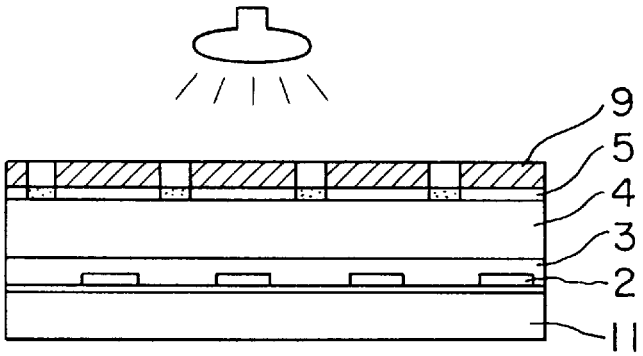
Figure 1E:
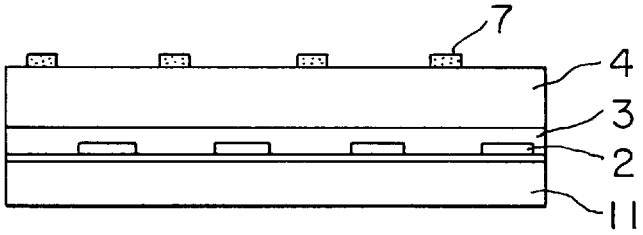

Thereafter, a first barrier-forming material layer 4 is formed by either coating a first barrier-forming material a plurality of times by screen printing to form a laminate or coating once a first barrier-forming material by blade coating, die coating or the like and conducting drying, and a second barrier-forming material layer 5 is formed in the same manner as used in the formation of the first barrier-forming material layer, except that an ionizing radiation-curable second barrier-forming material is used (FIG. 1C). The second barrier-forming material layer 5 is exposed through a predetermined photomask 9 to cure areas where an barrier is to be formed (FIG. 1D). Development is then performed to elute and remove the barrier-forming material remaining uncured to form a second barrier-forming material layer 7 in areas where a barrier is to be formed (FIG. 1E).

Figure 1F:
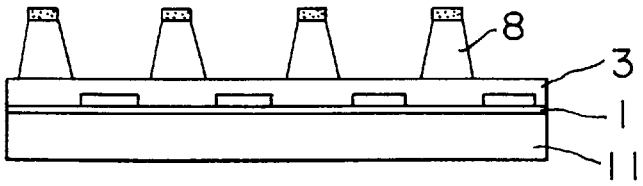

The first barrier-forming material layer 4 is cut by sandblasting using the second barrier-forming material layer 7 as a cutting mask and then fired to form a barrier 8 composed of a first barrier layer and a second barrier layer (FIG. 1F).

The process for producing a plasma display panel according to the second embodiment will be described with reference to FIG. 2.

FIG. 2 is a diagram showing the steps constituting another process for producing a plasma display panel according to the present invention.

Figure 2A:
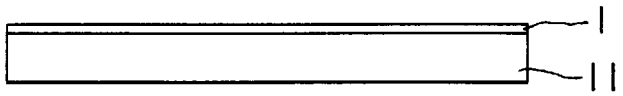
Figure 2B:
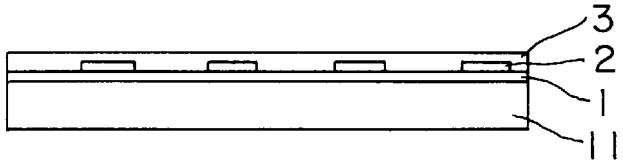

A primer layer 1 is, if necessary, formed on a glass substrate 11 (FIG. 2A). An address electrode 2 is then formed, and, if necessary, a dielectric layer 3 comprising a low-melting glass is then formed (FIG. 2B). The material, method, and object for forming the primer layer and the dielectric layer are the same as those in the first embodiment.

Figure 2C:
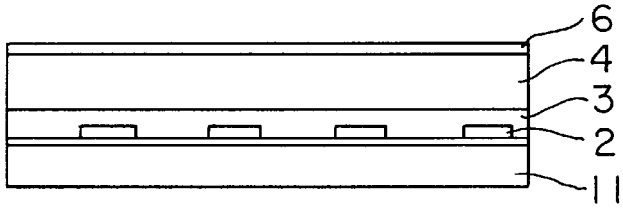

Thereafter, a first barrier-forming material layer 4 is formed by either coating a first barrier-forming material a plurality of times by screen printing to form a laminate or coating once a first barrier-forming material by blade coating, die coating or the like and conducting drying, and a third barrier-forming material layer 6 is then formed in the same manner as used in the formation of the first barrier-forming material layer, except that a third barrier-forming material is used (FIG. 2C).

The first function of the third barrier-forming material layer 6 is to prevent the separation of the second barrier-forming material, due to a difference in coefficient of thermal expansion between the first barrier-forming material layer and the second barrier-forming material layer, and breaking of the shape of the barrier at the time of firing of the barrier. For this, a third barrier-forming material having a coefficient of thermal expansion intermediate between the first barrier-forming material and the second barrier-forming material is selected and used for cushioning between these two materials. The second function of the third barrier forming material layer is to achieve an ideal color of the barrier. Preferably, the top of the barrier has a dark color from the viewpoints of improving the contrast of an image and preventing the reflection of external light. On the other hand, the portions other than the top in the barrier preferably has a bright color from the viewpoint of effectively radiating light, emitted from the phosphor, toward the front surface.

Use of a bright color in the first barrier-forming material layer raises no problem. However, use of a dark color in the second barrier-forming material layer results in limited usable material because the second barrier-forming material layer, due to its dark color, absorbs ultraviolet light as exposure light, making it difficult to completely expose the second barrier-forming material layer.

This problem can be solved by using a transparent second barrier-forming material layer and providing a third barrier-forming material layer of dark color on the first barrier-forming material layer.

Figure 2D:
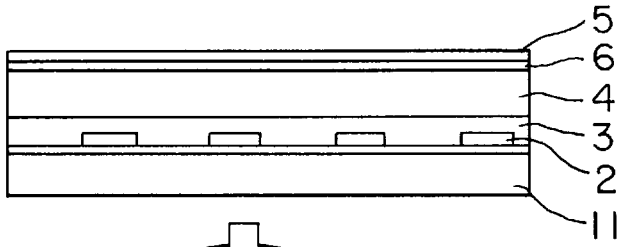
Figure 2E:
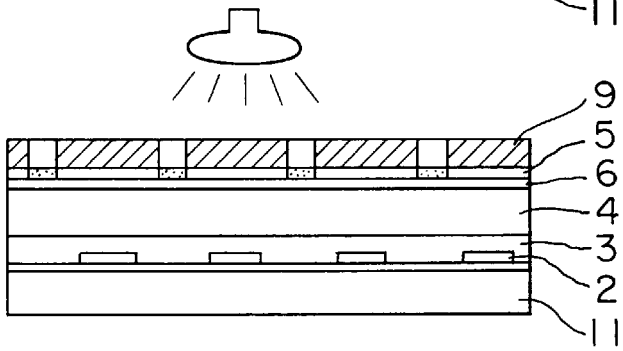
Figure 2F:
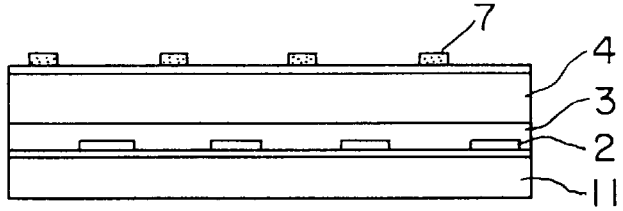

After the third barrier-forming material is coated, an ionizing radiation-curable second barrier-forming material is coated thereon in the same manner as described above to form the second barrier-forming material layer (FIG. 2D). The second barrier-forming material layer 5 is then exposed through a predetermined photomask to cure areas wherein a barrier is to be formed (FIG. 2E). Development is then performed to elute and remove the barrier-forming material uncured to form a second barrier-forming material layer 7 in only the areas where a barrier is to be formed (FIG. 2F).

Figure 2G:
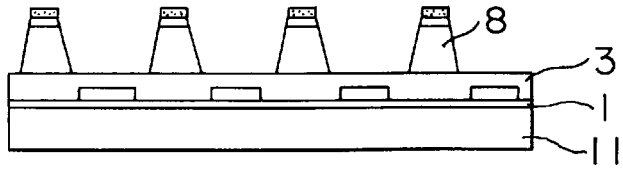

The first barrier-forming material layer 4 and the third barrier-forming material layer 6 are cut by sandblasting using the second barrier-forming material layer 7 as a cutting mask, followed by firing to form a barrier 8 composed of a first barrier layer, a third barrier layer, and a second barrier layer (FIG. 2G).

Requirements for each material and each section in the plasma display panel according to the present invention will be described.

The insulating substrate used in the present invention may be a conventional float glass. It, however, should be permeable to light and have uniform thickness. Examples of such glasses include those comprising $SiO_2$, $Al_2O_3$, MgO, and CaO as major components and $Na_2O$, $K_2O$, PbO, $B_2O_3$ and the like as auxiliary components.

The first barrier-forming material used in the present invention comprises: a glass paste of a mixture of a low-melting glass, composed mainly of PbO, with a filler for stabilizing the shape of the barrier during firing, and a binder resin; and optionally a pigment for coloring, a solvent, an additive and the like.

In general, the low-melting glass comprises: not less than 50% of PbO as a major component; and $Al_2O_3$, $B_2O_3$, $SiO_2$, MgO, CaO, SrO, BaO and the like added thereto from the viewpoints of imparting the effect of preventing phase separation of the glass, regulating the softening point, and regulating the coefficient of thermal expansion to that of the glass substrate.

A wide variety of refractory fillers are usable which do not soften at a firing temperature of about 500 to 600° C., and preferred examples of inexpensive fillers of such type include powders of ceramics such as alumina, magnesia, calcia, cordierite, silica, mullite, zircon, and zirconia.

When the formation of a barrier having a dark color is contemplated from the viewpoint of reducing the reflection of external light in PDP and enhancing the contrast in practical use, pigments, such as Co-Cr-Fe, Co-Mn-Fe, Co-Fe-Mn-Al, Co-Ni-Cr-Fe, Co-Ni-Mn-Cr-Fe, Co-Ni-Al-Cr-Fe, and Co-Mn-Al-Cr-Fe-Si, may be used as a refractory black pigment. On the other hand, when the formation of a white barrier is contemplated from the viewpoint of effectively leading light emitted from the phosphor to the front surface of the panel, titania ($TiO_2$) or the like may be used as the refractory white pigment.

The content of the low-melting glass in the inorganic component is preferably 50 to 80% by weight, more preferably 30 to 70% by weight. When it is excessively high, it is difficult to retain the shape of the barrier during firing. Further, removal of the binder is unsatisfactory resulting in deteriorated denseness. On the other hand, when it is excessively low, gaps among refractory filler particles cannot be satisfactorily filled with the glass, resulting in deteriorated denseness and, at the same time, deteriorated mechanical strength after firing, which in turn causes breaking of the barrier at the time of assembling of a panel.

The binder resin should be burned/decomposed/vaporized at a low temperature without leaving any carbide in the barrier, and preferred examples thereof include: cellulosic resins, such as ethyl cellulose, methyl cellulose, nitrocellulose, cellulose acetate, cellulose propionate, and cellulose butyrate; acrylic resins comprising polymers or copolymers of methyl (meth)acrylate, ethyl (meth)acrylate, n-butyl (meth)acrylate, isobutyl (meth)acrylate, isopropyl (meth)acrylate, 2-ethylmethyl (meth)acrylate, and 2-hydroxyethyl (meth)acrylate; poly-α-methylstyrene; polyvinyl alcohol; and polybutene.

Preferably, the binder resin is added in an amount of about 0.5 to 4.0% by weight based on the glass frit.

Plasticizers, surfactants, antifoamers, antioxidants and the like are optionally used as additives. Examples of plasticizers which are generally usable include phthalic esters, sebacic esters, phosphoric esters, adipic esters, glycolic esters, and citric esters. The addition of the plasticizer in an excessive amount increases the flexibility of the resin and results in lowered rate of cutting by sandblasting. For this reason, the amount of the plasticizer added is preferably not more than 1:5 in terms of the weight ratio of the amount of the plasticizer to the amount of the resin.

The first barrier-forming material layer should be formed by coating to a thickness of about 150 to 200 μm on a dry basis.

The solvent for the barrier-forming material is preferably a good solvent for the binder resin used, and preferred examples thereof include terpineol and butyl carbitol acetate.

The solvent is selected by taking mainly the volatility of the solvent and the solubility of the binder resin used into consideration. When the solubility of the binder in the solvent is lowered, the viscosity of the coating liquid is increased on an identical solid content basis, unfavorably deteriorating coatability.

When the content of the solvent is excessively low, the viscosity of the barrier-forming material is excessively high, posing problems including that it is difficult to remove air bubbles in the barrier-forming material and poor levelling results in poor smoothness of the coating surface. On the other hand, an excessively high content of the solvent poses problems including that dispersed particles rapidly settle making it difficult to stabilize the composition of the barrier-forming material and a large amount of energy and a lot of time are required for drying. For the above reason, the solvent content is preferably 25 to 50% by weight.

The process for producing a barrier-forming material according to the present invention is characterized by dispersing and blending a mixture comprising at least a low-melting glass powder, a refractory filler, a binder resin, and a solvent together by means of a ball mill.

Specifically, a binder resin is dissolved in a solvent, and, if necessary, an additive(s) is added thereto to prepare a solution (vehicle). Inorganic ingredients (a low-melting glass powder and a refractory filler) are mixed with the solution to prepare a mixture. This mixture is dispersed and blended by means of a ball mill. In this case, a ceramic ball is used in order to avoid the inclusion of impurities. More preferably, the internal wall of the ball mill is lined with a ceramic or a plastic. Thereafter, kneading is performed by means of a three-roll mill. Dispersing and blending are, if necessary, performed, followed by defoaming under reduced pressure by means of a vacuum agitator.

In the second barrier-forming material used in the present invention, an ionizing radiation-curable resin capable of serving as a cutting mask is used as a binder resin, and the binder resin content of the second barrier forming material is larger than that of the first barrier forming material to lower the cutting rate. The second barrier-forming material comprises a low-melting glass frit, composed mainly of PbO glass, and a filler and, if necessary, a pigment, a solvent, an additive(s) and the like.

The ionizing radiation-curable resin as the binder is a resin curable upon exposure to electron beam, ultraviolet light or the like, and examples thereof include an oligomer or a polymer having at least one unsaturated bond.

Specific examples thereof include: a polyester acrylate or a polyester methacrylate prepared by modifying a polyester comprising diethylene glycol/adipic ester or the like with acrylic acid or methacrylic acid; epoxy acrylate or epoxy methacrylate prepared by modifying an epoxy compound, prepared from bisphenol A and epichlorohydrin, with methacrylic acid or acrylic acid; polyurethane methacrylate or polyurethane acrylate prepared by modifying polyurethane with methacrylic acid or acrylic acid; a derivative prepared by introducing a polymerizable unsaturated group into an unsaturated polyester, cellulose, polymethacrylate, polyacrylate, polystyrene, poly-substituted styrene or the like; and a copolymer thereof.

If necessary, the second barrier-forming material may contain the same binder resin as contained in the first barrier-forming material.

In the present invention, the amount of the ionizing radiation-curable resin used is suitably 5 to 150 parts by weight based on 100 parts by weight of the low-melting glass frit. When the amount of the ionizing radiation-curable resin used is less than 5 parts by weight, separation or dissolution of the exposed and cured area occurs at the time of development. Further, in this case, the difference in blast rate between the first barrier-forming material layer and the second barrier-forming material layer is so small that the second barrier-forming material layer cannot serve as the mask. On the other hand, when it exceeds 150 parts by weight, expansion occurs at the time of firing, making it difficult to form a barrier.

When the ionizing radiation-curable resin is an ultraviolet-curable resin, a photopolymerization initiator, such as an acetophenone, a benzophenone, Michler's benzoyl benzoate, α-amyloxime ester, tetramethylthiuram monosulfide, or a thioxanthene, and/or a photosensitizer, such as n-butylamine, triethylamine, or tri-n-butylphosphine, are used as a mixture.

The other ingredients for the barrier-forming material may be the same as those used in the first barrier-forming material.

The thickness of the second barrier-forming material layer formed of a barrier material, for a cutting mask, utilizing an ionizing radiation-curable resin is suitably 5 to 30 when the thickness of the first barrier-forming material layer according to the present invention is presumed to be 100. When the thickness of the second barrier-forming material layer is less than 5, the barrier material layer for a cutting mask is entirely cut out before working of the barrier, making it difficult to retain the shape of the barrier. On the other hand, when it exceeds 30, a problem of the resolution in the development occurs, so that a high definition cannot be realized.

The unexposed area of the second barrier-forming material is eluted by development to leave a second barrier-forming material which constitutes a cutting mask for sandblasting.

In this case, after the elution of the second barrier-forming material, the first barrier-forming material is eluted causing sandetching. This results in deteriorated shape of the barrier which causes the first barrier-forming material layer to be likely to be separated from the second barrier-forming material layer. A third barrier-forming material layer may be provided from the viewpoint of improving the adhesion between the first barrier-forming material layer and the second barrier-forming material layer. For example, in order to form a third barrier-forming material layer, a material comprising a low-melting glass frit identical to that used in the first and second barrier-forming materials and a binder resin composed of a mixture of the binder resin used in the first barrier-forming material with the binder resin used in the second barrier-forming material (i.e., a mixture of an ionizing radiation-curable resin of an oligomer or a polymer having at least one unsaturated bond with a binder resin identical to that used in the first barrier-forming material) may be used to form a layer on the whole surface of the first barrier-forming material layer followed by irradiation with an ionizing radiation. The third barrier-forming material layer is formed in a much smaller thickness than the thickness of the second barrier-forming material layer. Alternatively, instead of the above resin, a resin having higher tackiness and adhesion may be used.

Thus, two or three barrier-forming material layers are laminated onto top of each other or one another, the laminate is exposed and developed in the same manner as described above to pattern the second barrier-forming material layer in a required form, and cutting is then performed by sandblasting using, as a cutting mask, the patterned second barrier-forming material layer having a lower cutting rate.

Preferably, each paste is coated by screen printing, die coating, blade coating, Komma coating, reverse roll coating, spray coating, gun coating, extrusion coating, lip coating or the like.

The coating is generally performed directly on the glass substrate or the like. In some cases, however, it is possible to a method wherein coating is performed on a film followed by transfer of the coating onto the glass substrate. Further, the formation of a mask layer and a barrier-forming layer on the film side followed by simultaneous transfer of these layers onto the glass substrate is possible. Furthermore, a method may be used wherein a mask layer, a barrier-forming layer, a dielectric layer, an electrode, a primer layer and the like are formed on a film, these layers are transferred at a time onto a glass substrate and the above working is performed. In this case, the binder resin component content of the dielectric layer is preferably higher than that of the first barrier-forming layer from the viewpoint of avoiding abrasion of the dielectric layer during the sandblasting of the barrier-forming layer. The amount of the resin binder is preferably 5 to 70 parts by weight, more preferably 10 to 40 parts by weight, based on 100 parts by weight of the glass frit.

The barrier-forming material is suitably dried under conditions of 120 to 170° C. for 3 to 30 min. If necessary, however, the drying should be performed as required in the formation of the first barrier-forming material by coating of the material a plurality of times or after the completion of the formation of the first barrier-forming material layer by coating.

Regarding exposure conditions of the second barrier-forming material layer, light at 365 to 420 nm is used in the case of ultraviolet light, and the dose is suitably 20 to 2000 $mJ/cm^2$, preferably 100 to 100 $mJ/cm^2$.

A solution capable of dissolving the uncured ionizing radiation-curable resin may be used for the development, and an example of such a solution is an aqueous alkali solution.

The height of the barrier is suitably 150 to 200 μm after firing. The firing may be performed by heating in air at 500 to 580° C.

In the process for producing a plasma display panel and the plasma display panel according to the present invention, the use of a bright color in the barrier in its portion close to the phosphor layer is useful for an increase in brightness of the display, while the use of a dark color in the barrier in its portion constituting the surface of the panel contributes to an improvement in contrast.

As described above, however, when the barrier has a two-layer structure wherein a dark color is used in the second barrier-forming material layer constituting the surface of the barrier, the dark color of the second barrier-forming material layer, which is originally photosensitive, poses a problem that, when curing is performed by ultraviolet irradiation, it is difficult for the ultraviolet light to permeate into the material layer. Therefore, in this case, an ultraviolet-curable resin having high sensitivity should be selected.

Both an increase in brightness of the display and an improvement in contrast can be attained by adopting a three-layer structure in the barrier, using a pigment having a bright color in the first barrier-forming material layer to be served as the surface portion of the panel, using a transparent second barrier-forming material layer to avoid the problem of the photosensitivity, and incorporating a pigment having a dark color in the third barrier-forming material layer as the intermediate layer.

The term "pigment having a bright color" refers to a pigment having a hue, possessing high lightness and high light reflectance, such as white, cream, or sepia, and the term "pigment having a dark color" refers to a pigment having a hue, possessing low lightness and light-absorptive property, such as black, blackish gray, or brown.

Although the barrier formation method has been described above as an example, the use, as the mask material, of an electrode material, a resistor material, or a dielectric material with a photosensitive resin added thereto permits pattern formation in the same manner as described above.

Second aspect

The second aspect of the present invention involves the step of forming a mask pattern for etching by printing.

The mask pattern-forming material used in this aspect of the present invention preferably comprises at least a resin component. This resin component is incorporated in such an amount as will occupy 5 to 100% by weight of the mask pattern-forming material in a dry state and is volatilizable or decomposable upon firing at a temperature of 600° C. or below, for example, at a temperature in the range of from 300 to 600° C. The mask pattern-forming material according to the present invention further comprises an inorganic powder having a softening temperature of 450 to 600° C.

As described above, the resin component constituting the mask pattern-forming material is such that it is volatilized and decomposed upon firing at a low temperature of 600° C. or below without leaving any carbide in the pattern-forming material. Examples of such resin components include resins as described in the first aspect, that is, cellulosic resins, acrylic resins, poly-α-methylstyrene, polyvinyl alcohol, and polybutene. However, when the mask pattern-forming material of the present invention is printed on a substrate by intaglio offset printing through an intermediate transfer medium described below, the use of a resin having a high molecular weight as the resin component necessitates the incorporation of a large amount of a solvent having a low molecular weight in the pattern-forming material, unfavorably deteriorating the stability of the pattern-forming material and causing swelling of the intermediate transfer medium. For this reason, the resin component is preferably an oligomer which is liquid at room temperature. On the other hand, when a resin having a low molecular weight is used, the molecular weight of the resin is preferably not less than 100.

When the volatilization or decomposition temperature of the resin component is above 600° C., the firing temperature for removing the resin component should be increased, unfavorably creating thermal deformation of the glass substrate in the formation of a thick layer pattern on a glass substrate used in a plasma display panel or the like. On the other hand, there is no lower limit on the volatilization or decomposition temperature of the resin component. The lower the volatilization or decomposition temperature of the resin component, the smaller the number of kinds of resin, which can be completely volatilized or decomposed, and the narrower the range of selection of the material. For this reason, the lower limit of the volatilization or decomposition temperature of the resin component is preferably about 300° C. Further, when the proportion of the resin component in the pattern-forming material in a dry state is less than 5% by weight, the flexibility of the pattern-forming material is unsatisfactory, offering no good etching resistance.

The inorganic powder usable in the mask pattern-forming material is composed mainly of an inorganic powder, which, upon firing, flows to permit the powder particles to be mutually adhered to one another, such as a low-melting glass frit. The inorganic powder may be used in combination with a ceramic powder, which does not soften upon firing, such as alumina or zirconia. Examples of such materials include those described above in connection with the first aspect. The content of the inorganic powder in the pattern-forming material is preferably 0 to 1900 parts by weight based on 100 parts by weight of the resin component. The content of the inorganic powder having a softening temperature of 450 to 600° C. in the whole inorganic component is preferably about 0 to 50% by weight. The above inorganic powder causes fusing upon volatilization or decomposition of the resin component by firing at 500 to 600° C. In this case, the fused inorganic component is present in the fired pattern-forming material, whereas neither a trace amount of the resin component nor any carbide is left in the fired pattern-forming material. When the softening temperature of the inorganic powder is above 600° C., the firing temperature should be high, unfavorably creating thermal deformation of a glass substrate used in a plasma display panel or the like in the formation of a thick layer pattern on the glass substrate. On the other hand, when it is below 450° C., the inorganic component causes fusing before complete decomposition and volatilization of the resin component, unfavorably creating voids. Further, in the production of a plasma display panel described below, sealing is performed at about 450° C. after the sintering. Therefore, in this case, the use of an inorganic powder having a low softening temperature is unfavorable.

In the formation of an electrode or a resistor, a metallic powder may be further incorporated.

Metallic powders usable herein include powders of gold, silver, copper, nickel, aluminum and the like, and a spherical metallic powder having an average particle diameter of 0.1 to 5 μm is particularly preferred.

This pattern-forming material may be prepared by mixing the resin component and the inorganic powder in a low-volatile solvent and either kneading these components by means of a roll mill to prepare a coating liquid in a paste form, or kneading these components by means of a ball mill or the like to prepare a coating liquid as a slurry. Low-volatile solvents usable herein include triethylene glycol monobutyl ether, triethylene glycol, polyethylene glycol, polypropylene glycol, dioctyl phthalate, and diisodecyl phthalate.

A process for forming a thick layer pattern will be described with reference to drawings. In the present invention, the thick layer pattern refers to a layer formed by coating a coating composed of a dispersion of a powder of a metal, a ceramic, a glass or the like in a resin component and sintering the coating and does not mean a layer having a large thickness.

FIG. 5 is a diagram illustrating a process for forming a thick layer pattern. According to the process for forming a thick layer pattern according to the present invention, as shown in FIG. 5A, as the first step, a first layer 52 is formed on a substrate 51. The first layer 52 is formed using a first layer-forming material, for example, a barrier material, an electrode material, a resistor material, or a dielectric material, by conventional coating means, such as screen printing, blade coating, Komma coating, reverse roll coating, spray coating, gun coating, extrusion coating, or lip coating. Alternatively, the first barrier-forming material may be coated on a film by the above coating means to form a coating, followed by transfer of the coating onto a substrate 1 to form a first layer 52. The use of the transfer method permits the first layer 52 to be formed in a pattern form in desired areas alone. Further, the transfer method advantageously offers good accuracy of the layer thickness and good surface smoothness. The thickness of the first layer 52 thus formed may be suitably determined according to the thickness of the contemplated thick layer pattern.

The first layer-forming material comprises a resin component and optionally an inorganic component or the like, and the resin component occupies 0.5 to 4% by weight of the first layer-forming material after drying. When the resin component is less than 0.5% by weight, the stability of the coating liquid for the first layer-forming material is poor. Further, in this case, cracking is created in the first layer formed by coating of the coating liquid and then drying the coating. On the other hand, when the resin component exceeds 4% by weight, the efficiency of the etching in the third step described below is unfavorably deteriorated.

The resin component used in the first layer may be the same as the material used in the first aspect and the above mask pattern.

The inorganic component which may be incorporated into the first layer-forming material is composed mainly of a refractory filler, which does not soften upon firing, and a low-melting glass frit which, upon firing, flows to cause mutual fusing. In this case, the materials described in the first aspect may be used in a preferred mixing ratio.

Figure 5A:
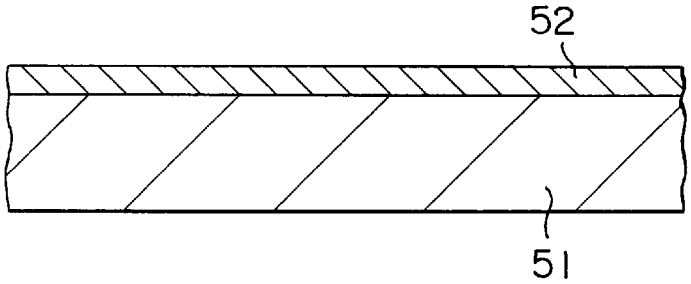
Figure 5B:
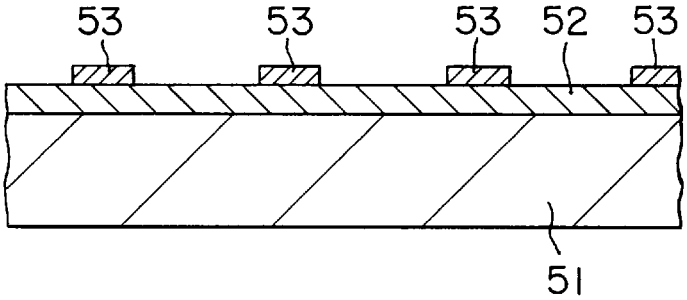

Next, in the second step, the above mask pattern-forming material according to the present invention is used as the second layer-forming material and printed in a predetermined pattern by printing on the first layer 52, and the print is dried to remove the solvent, thereby forming a second layer 53 (FIG. 5B). After drying, the above resin component occupies 5 to 100% by weight of the second layer, and, hence, the second layer possess suitable flexibility and excellent resistance to etching by the sandblasting described below. The thickness of the second layer 53 is preferably about 3 to 50 $\mu$m. When the thickness of the second layer 53 is less than 3 $\mu$m, no satisfactory etching resistance can be offered. On the other hand, when it exceeds 50 $\mu$m, the accuracy of the edge in the pattern is lowered, deteriorating the uniformity of the layer thickness. The pattern width of the second layer 53 may be suitably selected in the range of from 30 to 300 $\mu$m according to the contemplated thick layer pattern.

The second layer 53 may be formed by screen printing, intaglio printing, intaglio offset printing, lithographic offset printing, letterpress printing, and letterpress offset printing. Among them, intaglio offset printing and screen printing are preferred because a second layer having a thickness of about 3 to 50 $\mu$m can be stably formed with a high pattern accuracy.

Figure 6A:
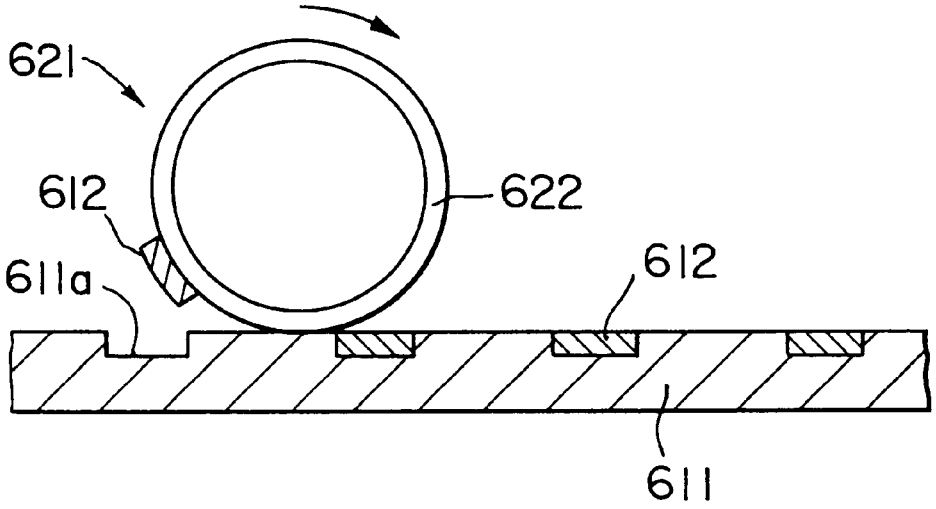
Figure 6B:
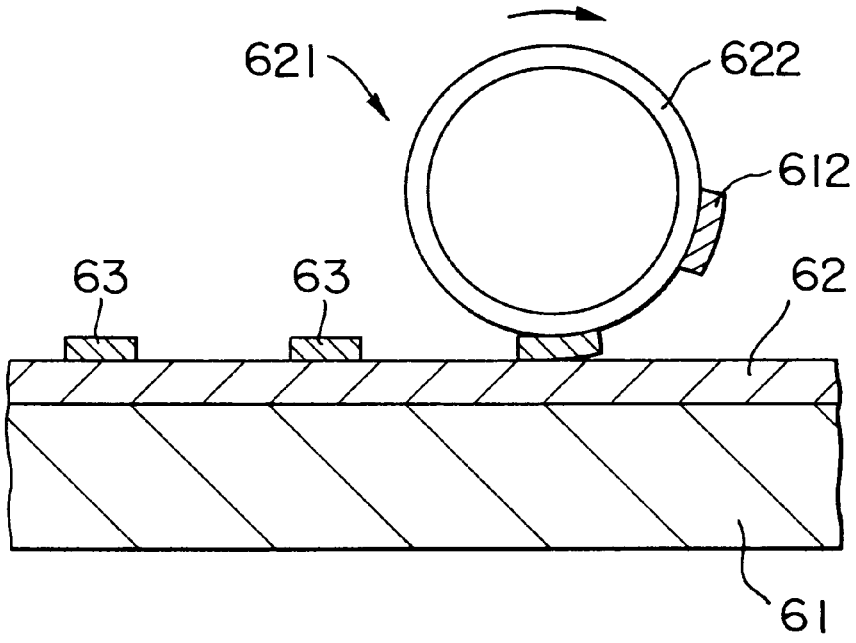

FIG. 6 is an explanatory diagram for the formation of the second layer in the second step by intaglio offset printing through an intermediate medium. In FIG. 6, at the outset, a second layer-forming material 612 constituted by the mask pattern-forming material according to the present invention is filled by means of a doctor blade into a depression 611*a* in a flat intaglio 611, and a blanket cylinder 621 as an intermediate transfer medium is rolled on the intaglio 611 (FIG. 6A). The blanket cylinder 621 is provided with a blanket 622 in the circumferential surface thereof, and the second layer-forming material 612 is transferred from the depression 611*a* in the intaglio 611 onto the blanket 622. Preferably, the intaglio 611 enhances the durability of the doctor blade and can offer excellent transfer of the second layer-forming material 612 onto the blanket 622. It may be formed of, for example, glass, a metal, or a composite thereof. The doctor blade is required to have scraping capability and durability and preferably made of SUS. The blanket cylinder 621 is then rolled on the first layer 62 formed on the substrate 61 to transfer the second layer-forming material 612 from the blanket 622 onto the first layer 62, thereby forming a second layer 63 (FIG. 6B). In this case, the percentage transfer of the second layer-forming material 612 from the blanket 622 onto the first layer 62 can be brought to 100% by using a silicone resin composed mainly of dimethylsiloxane units to form at least the outermost surface of the blanket 622 and using, as the second layer forming material 612, a material having a dynamic viscosity coefficient (10 Hz) in the range of from 500 to 4000 poise. Further, the above second layer having a thickness of 3 to 50 $\mu$m may be formed by using an intaglio 611 with the depth of the depression 611*a* (depression depth) being not less than 10 $\mu$m, preferably 10 to 50 $\mu$m, and using as the second layer-forming material 612 a material having a dynamic viscosity coefficient (10 Hz) in the range of from 500 to 4000 poise. When the dynamic viscosity coefficient (10 Hz) of the second layer-forming material 612 is less than 500 poise, the percentage transfer of the second layer-forming material 612 from the blanket 622 onto the first layer 62 is low. On the other hand, a dynamic viscosity coefficient exceeding 4000 poise results in deteriorated transfer of the second layer-forming material 612 from the intaglio 611 to the blanket 622, or otherwise causing part of the material to unfavorably remain unremoved in the doctor ring on the intaglio 611.

When the second layer 53 is formed by screen printing, the mesh size of the screen used is preferably about 100 to 500 mesh.

Figure 5C:
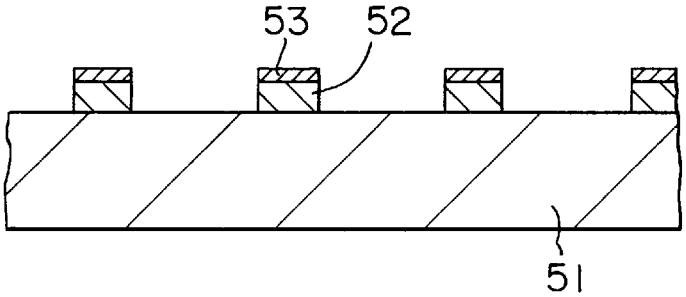

In the third step, the first layer 52 in its exposed area is removed by etching using the second layer 53 as a resist mark to form a pattern having a laminate structure of a first layer 25 and a second layer 53 (FIG. 5C). The etching is preferably the so-called "sandblasting" wherein a compressed gas with fine particles being incorporated therein is ejected at a high speed to physically perform etching.

Figure 5D:
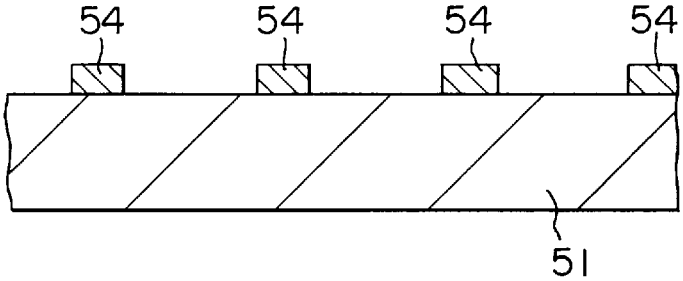

Thereafter, in the fourth step, firing is performed at 500 to 600° C. to form a thick layer pattern 54 of composed of a first layer 52 and a second layer 53 (FIG. 5D). In the fourth step, the resin component contained in the second layer 53, together with the resin component contained in the first layer 52, is volatilized or decomposed and removed without leaving any carbide. When the second layer 53 contains an inorganic powder, the inorganic powder contained in the second layer 53 causes fusing upon firing and is fused to the inorganic component, in a fused state, in the first layer 52. Thus, the second layer 53, which has served as the resist mask in the third step, can be removed without the need to provide the step of separation by the wet process. The thick-layer pattern layer 54 is fixed in satisfactory bond strength to the substrate 51.

Third aspect

According to a first embodiment, the mask pattern is formed by a process comprising the steps of:

(a) providing a sheet comprising a base film bearing a layer containing a photosensitive resin;

(b) subjecting the resin-containing layer to pattern exposure in a mask pattern form to form a cured area and an uncured area in the resin-containing layer;

(c) laminating the sheet onto the material layer for a pattern so as for the resin-containing layer side to face the pattern-forming material layer, thereby permitting the resin-containing layer in its uncured area alone to penetrate into the surface of the pattern-forming material layer; and (d) separating the base film from the pattern-forming material layer to remove the resin-containing layer in its cured area alone, thereby forming a mask pattern on the pattern-forming material layer.

In the above embodiment, the process may further comprise the steps of:

etching the pattern-forming material layer, with the mask pattern formed thereon by sandblasting, thereby patterning the pattern-forming material layer; and then firing the pattern-forming material layer with the mask pattern provided thereon and the mask layer, thereby integrating the pattern-forming material layer and at least part of the mask layer with each other, thereby preparing a plasma display panel.

According to a second embodiment, the mask pattern is formed by a process comprising the steps of:

(a) providing a mask sheet comprising a base film bearing a photosensitive mask layer;

(b) laminating the mask sheet onto the pattern-forming material layer so as for the mask layer side to face the pattern-forming material layer;

(c) subjecting the mask layer to pattern exposure in a mask pattern form to form a cured area and an uncured area in the mask layer; and (d) separating the base film from the pattern-forming material layer to remove the mask layer in its cured area alone, thereby forming a mask pattern on the pattern-forming material layer.

According to a third embodiment, the mask pattern may be formed by a process comprising the steps of:

(a) forming a photosensitive mask layer on the pattern-forming material layer; and (b) subjecting the mask layer to pattern exposure in a mask pattern form to form a mask pattern comprising (i) a hard, brittle high crosslinked portion and (ii) a soft uncrosslinked portion.

In the above embodiment, the process may further comprise the steps of:

etching the high crosslinked portion in the mask layer and the underlying pattern-forming material layer by sandblasting to pattern the pattern-forming material layer; and firing the pattern-forming material layer and the mask layer with the uncrosslinked portion remaining unremoved to burn off the resin component in the mask layer and, at the same time, to integrate the pattern-forming material layer and at least part of the mask layer with each other, thereby preparing a plasma display panel.

For example, the first process for forming a thick layer pattern comprises the steps of:

subjecting a pressure-sensitive adhesive sheet comprised of a base film having thereon a photosensitive pressure-sensitive adhesive resin layer to pattern exposure to form a cured area and an uncured area in the pressure-sensitive adhesive resin layer; forming a pattern-forming layer, formed of a pattern-forming material composed mainly of an inorganic powder and a resin binder, on an object; laminating the pressure-sensitive adhesive sheet onto the pattern-forming layer so that the pressure-sensitive adhesive resin layer side faces the pattern-forming layer, thereby permitting the pressure-sensitive adhesive resin layer in its uncured area to penetrate into the upper part of the pattern-forming layer; separating the base film from the pattern-forming layer to remove the pressure-sensitive resin layer in its cured area; performing sandblasting to remove the pattern-forming material in its area other than the penetrated area; and firing the pattern-forming material.

Further, for example, the second process for forming a thick layer pattern comprises the steps of: preparing a sheet comprised of a base film having thereon a photosensitive resin layer or a layer comprising a photosensitive resin and an inorganic powder; forming a pattern-forming layer, formed of a pattern-forming material composed mainly of an inorganic powder and a resin binder, on an object; laminating the sheet onto the pattern-forming layer so that the photosensitive resin layer side faces the pattern-forming layer; subjecting the photosensitive resin layer to pattern exposure to form a cured area and an uncured area; separating the base film from the pattern-forming layer to remove the photosensitive resin layer in its cured area; performing sandblasting to remove the pattern-forming material in its area other than the uncured area; and firing the pattern-forming material.

Further, for example, the third process for forming a thick layer pattern comprises the steps of: forming a pattern-forming layer, formed of a pattern-forming material composed mainly of an inorganic powder and a resin binder, on an object; forming a photosensitive resin layer or a layer comprising a photosensitive resin and an inorganic powder on the pattern-forming layer; subjecting the photosensitive resin layer to pattern exposure to form a high crosslinked portion and an uncrosslinked portion; removing the high crosslinked portion in the photosensitive resin layer together with the underlying pattern-forming material by sandblasting; and performing firing to burn off the resin component in the uncured portion in the rubbery resin layer and, at the same time, to sinter the pattern-forming material.

The present invention can be widely applied in the formation of a thick layer pattern by sandblasting. The term "thick layer" used herein refers to a layer formed by dispersing a metal, a ceramic, a glass or the like in a vehicle, coating the dispersion, and then sintering the coating and does not mean a layer having a large thickness. Incidentally, the present invention can be applied to the formation of a pattern having a layer thickness of about 2 $\mu$m and is applicable to the formation of an electrode, a resistor, or a dielectric layer.

Any of the pattern-forming material, preferred composition thereof, process for forming a pattern described above in connection with the first and second aspect may be applied to those in a barrier, an electrode or the like.

EXAMPLE A1

The barrier for PDP according to the present invention is usable in both AC type and DC type PDPs. In this example, the process for producing PDP according to the present invention will be described by taking AC type PDP as an example according to a process diagram shown in FIG. 2.

A coating liquid, for a primer layer, having the following composition was coated on a glass substrate by screen printing, and the coating was dried. The coating liquid had a viscosity of about 40000 cps, and the thickness of the coating after drying was 15 μm. Thereafter, the coating was then fired at a temperature of 600° C. to form a primer layer (FIG. 2A).

(Composition of coating liquid)

| | |
|---|---|
| PbO-based low-melting glass (MB-010, manufactured by Matsunami Garasu Kogyo) | 60 parts by weight |
| Filler (α-Alumina RA-40, manufactured by Iwatani Kagaku Kogyo) | 20 parts by weight |
| Ethyl cellulose resin (Ethocel STD100, manufactured by Dow Corning) | 2 parts by weight |
| Solvent (terpineol) | 18 parts by weight |

Then, an address electrode was formed thereon using a silver paste by screen printing, followed by the formation of the following dielectric layer (FIG. 2B).

The following ingredients:

| | |
|---|---|
| Glass frit {main components: $Bi_2O_3$, $ZnO_2$, and $B_2O_3$ (alkali-free), average particle diameter 3 μm} | 70 parts by weight |
| $TiO_2$ | 3 parts by weight |
| $Al_2O_3$ | 7 parts by weight |

(Mixture of the above inorganic ingredients: softening point 570° C., Tg 485° C., coefficient of thermal expansion $\alpha_{300}=80\times10^{-7}/°C.$)

| | |
|---|---|
| η-Butyl methacrylate/hydroxyethylhexyl methacrylate copolymer (8/2) | 10 parts by weight |
| Benzyl butyl phthalate | 7 parts by weight |
| Isopropyl alcohol | 15 parts by weight |
| Methyl ethyl ketone | 5 parts by weight |

were mixed and dispersed in one another by means of a beads mill to prepare a coating liquid which was then coated by Komma coating on the electrode-bearing layer, and the coating was dried at 100° C. to form a dielectric layer having a thickness of 20±2 μm.

Thereafter, a first barrier-forming material having the following composition was coated by means of a screen printing device so as to uniformly cover the surface of the glass substrate including the address electrode and the dielectric layer. In this case, the coating and drying were repeated a plurality of times to form a first barrier forming material layer having a thickness of 200 μm (FIG. 2C).

The first barrier-forming material had a heat shrinkage of 0.75.

(Composition of coating liquid for first barrier-forming material layer)

| | |
|---|---|
| PbO-based low-melting glass (MB-008, manufactured by Matsunami Garasu Kogyo) | 60 parts by weight |

-continued

| | |
|---|---|
| Filler (α-Alumina RA-40, manufactured by Iwatani Kagaku Kogyo) | 10 parts by weight |
| Ethyl cellulose resin (Ethocel STD 100, manufactured by Dow Corning) | 2 parts by weight |
| Pigment ($TiO_2$) | 10 parts by weight |
| Solvent (terpineol) | 18 parts by weight |

The heat shrinkage was expressed in terms of a ratio of the layer thickness after firing to the layer thickness before firing (heat shrinkage=(layer thickness after firing)/(layer thickness before firing).

In order to improve the adhesion between the first barrier-forming material layer and the second barrier-forming material layer, a third barrier-forming material having the following composition was coated, after the formation of the first barrier-forming material layer, by means of a screen printing device to form a third barrier-forming material layer (FIG. 2C).

The third barrier-forming material layer had a thickness of 15 μm, and the heat shrinkage of the third barrier-forming material was 0.625.

(Composition of coating liquid for third barrier-forming material layer)

| | |
|---|---|
| PbO-based low-melting glass (MB-008, manufactured by Matsunami Garasu Kogyo) | 57 parts by weight |
| Filler (α-Alumina RA-40, manufactured by Iwatani Kagaku Kogyo) | 10 parts by weight |
| Ethyl cellulose resin (Ethocel STD 100, manufactured by Dow Corning) | 5 parts by weight |
| Pigment (Co—Cr—Fe-based black pigment) (Daipyroxide Black #9510, manufactured by Dainichiseika Color & Chemicals Manufacturing Co., Ltd.) | 10 parts by weight |
| Solvent (terpineol) | 18 parts by weight |

Subsequently, a second barrier-forming material having the following composition using an ultraviolet-curable resin was coated by means of a screen printing device to a thickness of 15 μm on the third barrier-forming material layer 6 which had been provided on the first barrier-forming material layer 4 (FIG. 2D). The second barrier-forming material was free from any pigment and was transparent.

The second barrier-forming material had a heat shrinkage of 0.5.

(Composition of coating liquid for second barrier-forming material layer)

| | |
|---|---|
| PbO-based low-melting glass (MB-008, manufactured by Matsunami Garasu Kogyo) | 60 parts by weight |
| Filler (α-Alumina RA-40, manufactured by Iwatani Kagaku Kogyo) | 10 parts by weight |
| Ultraviolet-curable resin | 10 parts by weight |
| Solvent (terpineol) | 20 parts by weight |

The ultraviolet-curable resin had the following composition.

(Composition of ultraviolet-curable resin)

| | |
|---|---|
| Copolymer of methyl methacrylate with methacrylic acid: monomer A (TEOTA) | 66.7 parts by weight |
| 1000-Polyoxyethylated trimethylolpropane triacrylate: monomer B (TMPTA) | 19.9 parts by weight |
| Trimethylolpropane triacrylate | 4.7 parts by weight |
| Polymerization initiator: benzophenone | 7.6 parts by weight |
| Polymerization initiator: Michler's ketone | 1.1 parts by weight |

After the formation of the barrier-forming material layer having a three-layer structure, the whole barrier-forming material layer was dried in a clean oven at 170° C. for 20 min.

Thereafter, ultraviolet light at 365 nm was applied at a dose of 500 mJ/cm$^2$ by means of an exposing device to the material layer in its area to be served as a barrier through a photomask 9 of a glass substrate to selectively expose the material layer (FIG. 2F). The width of the barrier defined by the photomask was 70 $\mu$m, and the barrier-barrier pitch was 200 $\mu$m.

The barrier-forming material layer formed of a photosensitive material in the laminate structure of the barrier-forming material layer having a three-layer structure was developed to elute a nonexposed area in the second barrier-forming material layer in the barrier-forming material layer to form a cutting mask for sandblasting (FIG. 2E). In the development, an aqueous sodium carbonate solution (1% by weight) was used as a developing solution.

Thereafter, drying was performed in a clean oven at 120° C. for 30 min.

After the second barrier-forming material layer was patterned in a required form, cutting was performed by sandblasting using as the cutting mask a photosensitized second barrier-forming material layer 7 having a lower cutting rate.

An alumina powder was used in the sandblasting. After cutting, the barrier-forming material layer was fired at 550° C. for 180 min, thereby completing the barrier for a plasma display panel according to the present invention (FIG. 2F).

The barrier for a plasma display panel was uniform in a height of 180 $\mu$m, the width of bottom of the barrier was 100 $\mu$m, the pitch was 200 $\mu$m, and the ratio of the half-vale width to the width of the bottom was 0.8.

The sandblasted surface had good appearance and satisfactory shape.

Figure 3:
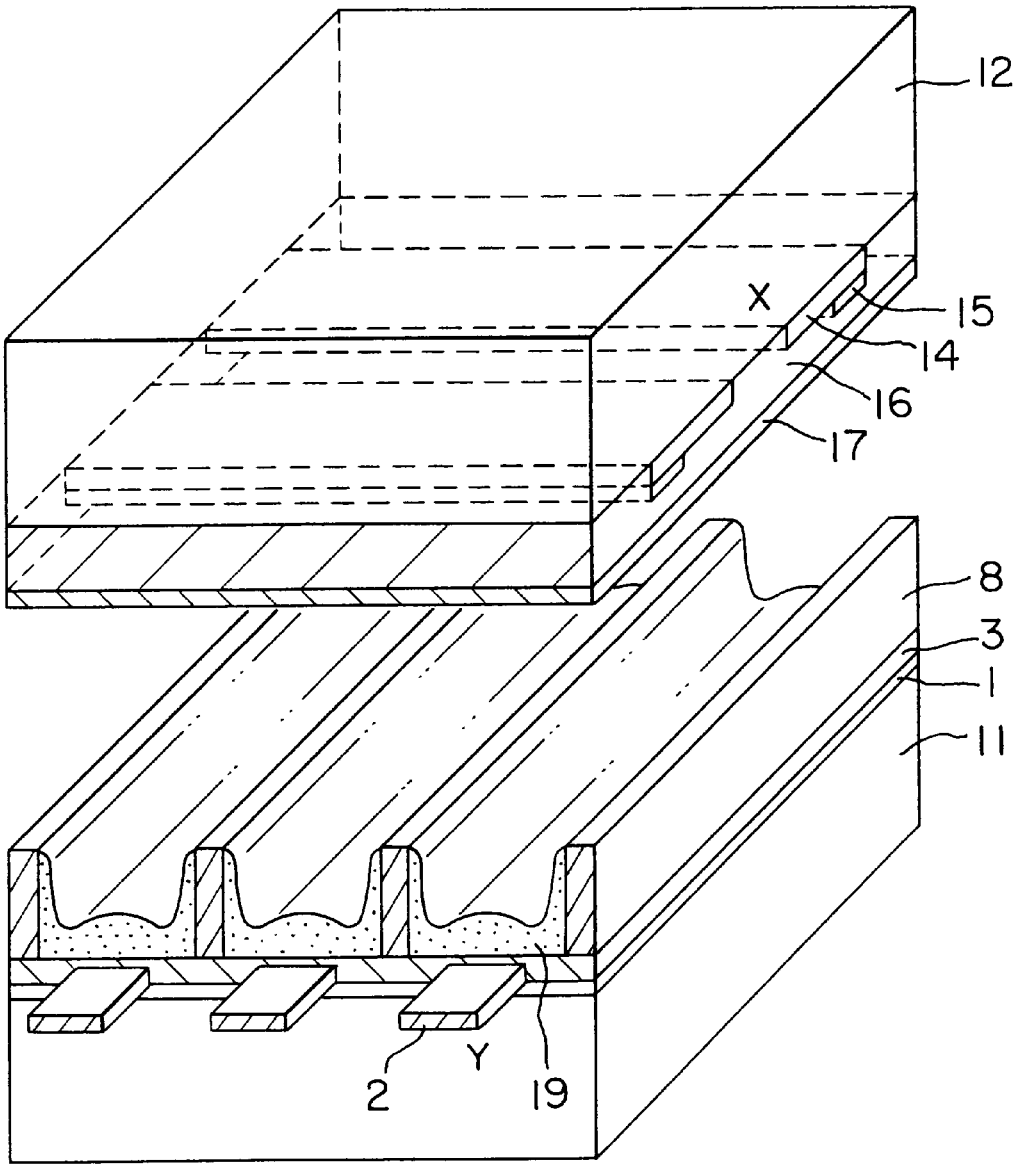
FIGS. 3 and 4 are diagrams showing a general construction of a plasma display panel.
Figure 4:
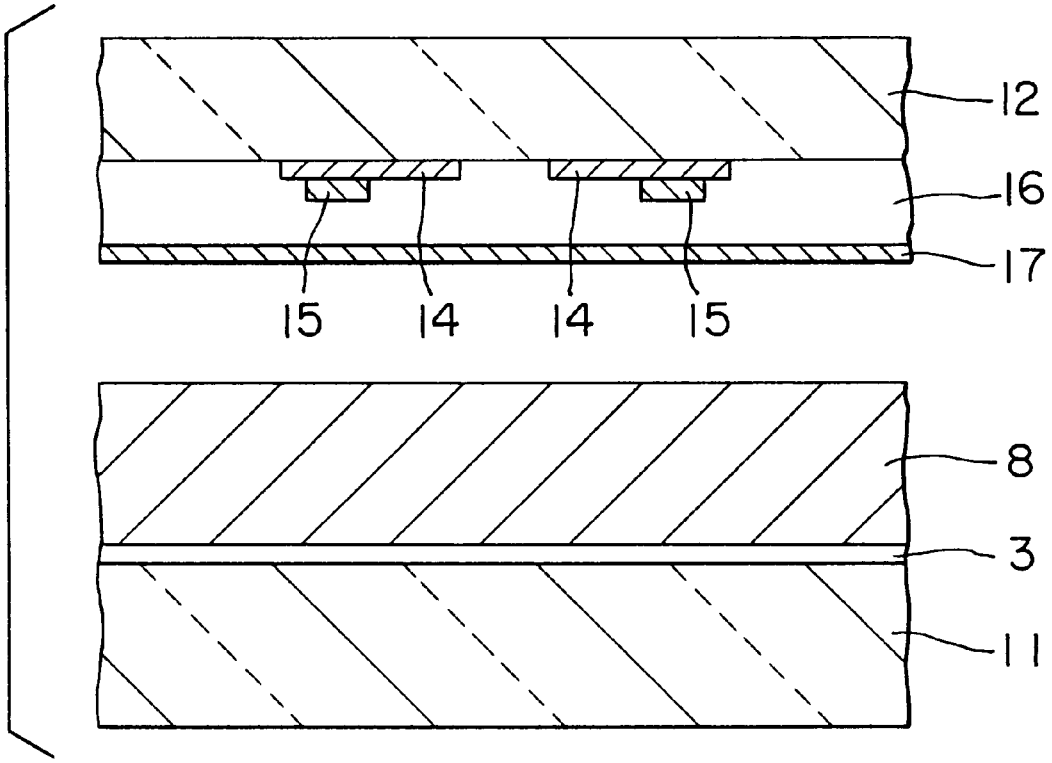

Desired R, G, and B phosphor faces were formed between barriers, followed by sealing to a front plate, shown in FIG. 3, comprising a sustaining electrode, a dielectric layer, and an MgO layer. A Xe-Ne gas was then filled to prepare a plasma display panel.

EXAMPLE A2

The procedure of Example A1 was repeated up to the step at which a dielectric layer was formed. Thereafter, the following ingredients:

| | |
|---|---|
| Glass frit (MB-008, manufactured by Matsunami Garasu Kogyo | 65 parts by weight |
| α-Alumina RA-40, manufactured by Iwatani Kagaku Kogyo | 10 parts by weight |
| White pigment ($TiO_2$) | 10 parts by weight |
| Ethyl cellulose | 3 parts by weight |
| Propylene glycol monomethyl ether | 5 parts by weight |
| Isopropyl alcohol | 20 parts by weight |

| | |
|---|---|
| Glass frit (MB-010, manufactured by Matsunami Garasu Kogyo | 65 parts by weight |
| α-Alumina RA-40, manufactured by Iwatani Kagaku Kogyo | 10 parts by weight |
| Daipyroxide Black #9510 (manufactured by Dainichiseika Color & Chemicals Manufacturing Co., Ltd.) | 10 parts by weight |
| Propylene glycol monomethyl ether | 20 parts by weight |
| Photosensitive resin (details: | 20 parts by weight |
| Methyl methacrylate/ methacrylic acid copolymer, acid value 100 mg KOH/g | 100 parts by weight |
| Polyoxyethylated trimethylolpropane triacrylate | 70 parts by weight |
| Photoinitiator ("Irgacure 907," manufactured by CIBA-GEIGY) | 10 parts by weight |

were kneaded and dispersed in one another by means of a three-roll mill, the resultant coating liquid was coated by Komma coating on the first barrier-forming layer and the coating was dried at 100° C. to form a 30 $\mu$m-thick second barrier-forming layer.

In the same manner as in Example A1, exposure, development of the second barrier-forming layer, and sandblasting were performed to form a barrier composed of a white barrier having thereon a black barrier. Further, the procedure of Example A1 was repeated to prepare a plasma display panel.

As is apparent from the foregoing description, the formation of a mask using a photosensitive barrier-forming material instead of the conventional cutting mask formed of a photosensitive resist can eliminate the need to provide the step of separating the cutting mask after sandblasting and results in the formation of a barrier having a uniform shape. Further, since the cutting mask is formed of the same material as the barrier-forming material, the adhesion is so high that the separation of the cutting mask during blasting can be prevented, enabling the formation of a barrier having a uniform shape.

The use of a barrier-forming material having a dark color results in improved contrast, while the use of a barrier-forming material having a bright color results in improved luminescence brightness. The adoption of a barrier layer having a multilayer structure offers both the above effects in a superimposed form.

EXAMPLE B1

A Silver electrode pattern was formed using a paste for a thick layer by firing on a 2 mm-thick glass substrate.

Then, in the first step, a paste, for a barrier, having the following composition was coated as a first layer-forming material by means of a reverse roll coater on the glass substrate with an electrode pattern formed thereon, the coating was dried by means of a hot plate at 100° C. for 30 min and then at 170° C. for 20 min to form a first layer having an average thickness of 150 μm (corresponding to FIG. 5A).

Composition of Paste for Barrier

| | |
|---|---|
| Glass frit (KF6274, manufactured by Iwaki Glass Co., Ltd.) | 80 parts by weight |
| Ethyl cellulose (Ethocel STD100, manufactured by Dow Chemical Company) | 1 part by weight |
| Butyl carbitol acetate | 19 parts by weight |

Separately, nine pattern-forming materials (A to I) having the following respective compositions were prepared. The dynamic viscosity coefficient (10 Hz) of the pattern-forming materials is given in the following Table B1.

Composition of pattern-forming material A

| | |
|---|---|
| Ethyl cellulose (N-22, manufactured by Hercules) (decomposition temp. 400° C.) | 10 parts by weight |
| Polyethylene glycol monomethacrylate (M40G, decomposition temp. 560° C., manufactured by Shin-Nakamura Chemical Co., Ltd.) | 90 parts by weight |
| Glass frit (average particle diameter 4 μm, softening temp. 480° C.) (KF-6274, manufactured by Iwaki Glass Co., Ltd.) | 50 parts by weight |

Composition of pattern-forming material B

| | |
|---|---|
| Maleinized polybutene (MPB, manufactured by Nippon Oils & Fats Co., Ltd.) (decomposition temp. 480° C.) | 50 parts by weight |
| Glass frit (average particle diameter 4 μm, softening temp. 480° C.) (KF-6274, manufactured by Iwaki Glass Co., Ltd.) | 50 parts by weight |

Composition of pattern-forming material C

| | |
|---|---|
| Acrylic resin (decomposition temp. 550° C.) (Polyflow No. 3, manufactured by Kyoeisha Chemical Co., Ltd.) | 95 parts by weight |
| Glass frit (average particle diameter 4 μm, softening temp. 480° C.) (MB-13, manufactured by Matsunami Garasu Kogyo) | 5 parts by weight |

Composition of pattern-forming material D

| | |
|---|---|
| Polyethylene glycol monomethacrylate (M40G, decomposition temp. 560° C., manufactured by Shin-Nakamura Chemical Co., Ltd.) | 80 parts by weight |

-continued

| | |
|---|---|
| Methacrylic resin (decomposition temp. 330° C.) (BR105, manufactured by Mitsubishi Rayon Co., Ltd.) | 20 parts by weight |

Composition of pattern-forming material E

| | |
|---|---|
| Triethylene glycol monobutyl ether | 94 parts by weight |
| β-Methacryloyloxyethylene hydrogen phthalate (CB-1, decomposition temp. 390° C., manufactured by Shin-Nakamura Chemical Co., Ltd.) | 1 part by weight |
| Methacrylic resin (decomposition temp. 330° C.) (BR105, manufactured by Mitsubishi Rayon Co., Ltd.) | 5 parts by weight |

Composition of pattern-forming material F

| | |
|---|---|
| Triethylene glycol monobutyl ether | 94 parts by weight |
| β-Methacryloyloxyethylene hydrogen phthalate (CB-1, decomposition temp. 390° C., manufactured by Shin-Nakamura Chemical Co., Ltd.) | 2 part by weight |
| Methacrylic resin (decomposition temp. 330° C.) (BR105, manufactured by Mitsubishi Rayon Co., Ltd.) | 3.5 parts by weight |

Composition of pattern-forming material G

| | |
|---|---|
| Polybutene (3N, decomposition temp. 450° C., manufactured by Nippon Oils & Fats Co., Ltd.) | 50 parts by weight |
| Glass frit (average particle diameter 4 μm, softening temp. 480° C.) (KF-6274, manufactured by Iwaki Glass Co., Ltd.) | 50 parts by weight |

Composition of pattern-forming material H

| | |
|---|---|
| Polybutene (200N, decomposition temp. 460° C. manufactured by Nippon Oils & Fats Co., Ltd.) | 50 parts by weight |
| Glass frit (average particle diameter 4 μm, softening temp. 480° C.) (KF-6274, manufactured by Iwaki Glass Co., Ltd.) | 50 parts by weight |

Composition of pattern-forming material I

| | |
|---|---|
| Triethylene glycol monobutyl, ether | 40 parts by weight |
| Ethyl cellulose (N-200, decomposition temp. 400° C., manufactured by Hercules) | 10 parts by weight |
| Glass frit (average particle diameter 4 μm, softening temp. 480° C.) (KF-6274, manufactured by Iwaki Glass Co., Ltd.) | 50 parts by weight |

In the second step, the above pattern-forming materials (A to I) were used as the second layer-forming material and printed on the first layer by means of an intaglio offset printer, and the prints were dried at 80° C. for 5 min, thereby forming a second layer of a stripe pattern having a line width of 80 μm and a pitch of 220 μm (corresponding to FIG. 5B).

The intaglio used in this case was prepared by etching a soda-lime glass plate to form depressions having a depth specified in the following Table B1. A blanket cylinder with a blanket prepared by casting a cold cure silicone rubber onto a polyester film was used as an intermediate medium. The thickness of the second layer and the resin component content are summarized in Table B1.

Subsequently, in the third step, unnecessary areas in the first layer was etched away by sandblasting under the following conditions using the second layer as a resist mask (corresponding to FIG. 5C). The amount of etching in the first layer/the amount of etching in the second layer (relative blast ratio) in this etching is summarized in the following Table B1.

Etching conditions

Distance between nozzle and substrate surface: 8 cm

Abrasive material: brown fused alumina #1000

Ejection pressure: 3 kg/cm$^2$

Etching time: 35 min

In the fourth step, firing was performed at a peak temperature of 560° C. (peak temperature retention time 20 min) to remove the resin component in the second layer, which had served as the resist mask, and to integrate the first layer with the second layer, thereby forming a thick layer pattern (a barrier) fixed to a glass substrate (corresponding to FIG. 5D). Thus, samples 1 to 11 were prepared.

Evaluation results of the thick layer patterns (barriers) are summarized in the following Table B1.

TABLE B1

| | Pattern-forming material for 2nd layer | | | 2nd layer | | | |
|---|---|---|---|---|---|---|---|
| Sample | Composition | Viscosity (poise) | Depression depth of intaglio (μm) | Thickness (μm) | Resin composition content (wt %) | Relative blast ratio | Evaluation results of thick layer pattern |
| 1 | A | 1500 | 20 | 5 | 70 | 400 | Good |
| 2 | B | 2000 | 15 | 4 | 50 | 300 | Good |
| 3 | B | 2000 | 8 | 2 | 50 | 90 | Significantly ununiform |
| 4 | C | 500 | 10 | 3 | 95 | 150 | Good |
| 5 | C | 500 | 20 | 5 | 95 | 300 | Good |
| 6 | D | 2300 | 15 | 4 | 20 | 250 | Good |
| 7 | E | 700 | 15 | 4 | 5 | 110 | Good |
| 8 | F | 500 | 15 | 3.5 | 3.5 | 90 | Significantly ununiform |
| 9 | G | 450 | 15 | 4 | 50 | 280 | Significantly ununiform |
| 10 | H | 6000 | 15 | 4 | 50 | — | Smudged |
| 11 | I | 4500 | 15 | 4 | 50 | — | Smudged |

As is apparent from Table B1, for the samples using a pattern-forming material, which provides a second layer with 5 to 95% by weight thereof being occupied by a resin component having a decomposition temperature of 600° C. or below (300 to 600° C.), and having a dynamic viscosity coefficient (10 Hz) in the range of from 500 to 400 poise and using an intaglio having a depression depth of 10 to 50 μm (samples 1 and 2 and 4 to 7), the blasting in the third step could be performed in a high relative blast ratio, and a good layer pattern (barrier) having an average line width in top of about 40 μm and a height of about 120 μm and possessing surface smoothness free from a break. Further, no breaking of the electrode pattern occurred.

By contrast, for sample 3 using an intaglio having a depression depth of 8 μm, the thickness of the second layer was 2 μm, the relative blast ratio was as low as 90, and the thick layer pattern (barrier) was remarkably uniform. For sample 8 using pattern-forming material F, which provides a resin component content in the second layer of 3.5% by weight, the relative blast ratio was 90, i.e., insufficient for the second layer to serve as a resist mask, and the thick layer pattern (barrier) was remarkably uniform.

On the other hand, sample 9 using pattern-forming material G having a dynamic viscosity coefficient (10 Hz) of less than 500 poise (450 poise), the thick layer pattern (barrier) was uniform although the relative blast ratio was large. Further, this sample suffered from occurrence of ink residue in the blanket. For samples 10 and 11 using pattern-forming materials H and I having a dynamic viscosity coefficient (10 Hz) exceeding 400 poise (6000 to 4500 poise), unsatisfactory scraping occurred in doctor ring in the intaglio, and a smudge occurred at the time of formation of the second layer, making it impossible to form a good thick layer pattern (barrier).

Comparative Example B1

At the outset, a silver electrode pattern was formed on a 2.2 mm-thick glass substrate in the same manner as in the first step of Example B1, and a first layer having an average thickness of 150 μm was then formed.

Thereafter, a pattern-forming material having the following composition was provided.

Composition of Pattern-Forming Material

| | |
|---|---|
| Ethyl cellulose (N-10, decomposition temp. 390° C., manufactured by Hercules | 26 parts by weight |
| Toluene | 52 parts by weight |
| Ethanol | 12 parts by weight |
| Dibutyl phthalate | 10 parts by weight |

The above pattern-forming material was used as a material for a second layer and printed on the first layer by means of an intaglio offset printer, followed by drying at 80° C. for 5 min to attempt the formation of a second layer having a stripe pattern having a line width of 80 μm and a pitch of 220 μm. The intaglio used in this case was prepared by etching a soda-lime glass plate to form depressions having a depth of 20 μm. A blanket cylinder with a blanket prepared by casting a cold cure silicone rubber onto a polyester film was used as an intermediate medium.

However, the solvent component in the pattern-forming material was absorbed into a silicone rubber of the blanket, and the pattern-forming material solidified on the blanket, making it impossible to conduct the formation of a second layer by transfer.

Comparative Example B2

At the outset, in the first step, a silver electrode pattern was formed on a 2.2 mm-thick glass substrate in the same manner as in the first step of Example B1, and a first layer having an average thickness of 150 μm was further formed.

Separately, the following six pattern-forming materials (pattern-forming materials I to VI) were provided.

| Composition of pattern-forming material I | |
|---|---|
| Ethyl cellulose (N-22, decomposition temp. 400° C., manufactured by Hercules) | 10 parts by weight |
| Butyl carbitol acetate (volatilization temp. 170° C.) | 40 parts by weight |
| Glass frit (average particle diameter 4 μm, softening temp. 480° C.) (KF-6274, manufactured by Iwaki Glass Co., Ltd.) | 50 parts by weight |

| Composition of pattern-forming material II | |
|---|---|
| Butyl carbitol acetate (volatilization temp. 170° C.) | 20 parts by weight |
| Methacrylic resin (decomposition temp. 330° C.) (BR105, manufactured by Mitsubishi Rayon Co., Ltd.) | 10 parts by weight |
| Glass frit (average particle diameter 4 μm, softening temp. 480° C.) (KF-6274, manufactured by Iwaki Glass Co., Ltd.) | 70 parts by weight |

| Composition of pattern-forming material III | |
|---|---|
| Ethyl cellulose (N-200, decomposition temp. 400° C., manufactured by Hercules) | 10 parts by weight |
| Butyl carbitol acetate (volatilization temp. 170° C.) | 80 parts by weight |
| Glass frit (average particle diameter 4 μm, softening temp. 480° C.) (MB-13, manufactured by Matsunami Garasu Kogyo) | 10 parts by weight |

| Composition of pattern-forming material IV | |
|---|---|
| Ethyl cellulose (N-200, decomposition temp. 400° C., manufactured by Hercules) | 7 parts by weight |
| Butyl carbitol acetate (volatilization temp. 170° C.) | 83 parts by weight |
| Glass frit (average particle diameter 4 μm, softening temp. 480° C.) (KF-6274, manufactured by Iwaki Glass Co., Ltd.) | 10 parts by weight |

-continued

| Composition of pattern-forming material V | |
|---|---|
| Ethyl cellulose (N-22, decomposition temp. 400° C., manufactured by Hercules) | 4.2 parts by weight |
| Butyl carbitol acetate (volatilization temp. 170° C.) | 15.8 parts by weight |
| Glass frit (average particle diameter 4 μm, softening temp. 480° C.) (KF-6274, manufactured by Iwaki Glass Co., Ltd.) | 80 parts by weight |

| Composition of pattern-forming material VI | |
|---|---|
| Ethyl cellulose (N-22, decomposition temp. 400° C., manufactured by Hercules) | 3.4 parts by weight |
| Butyl carbitol acetate (volatilization temp. 170° C.) | 16.6 parts by weight |
| Glass frit (average particle diameter 4 μm, softening temp. 480° C.) (KF-6274, manufactured by Iwaki Glass Co., Ltd.) | 80 parts by weight |

Thereafter, in the second step, the above pattern-forming materials (I to VI) were used as the material for a second layer and printed on the first layer by means of an intaglio offset printer, followed by drying at 80° C. for 5 min to form a second layer of a stripe pattern having a line width of 80 μm and a pitch of 220 μm.

Subsequently, in the third step, unnecessary areas in the first layer were etched away by sandblasting in the same manner as in the third step of Example 1. The amount of etching in the first layer/the amount of etching in the second layer (relative blast ratio) in this etching is summarized in the following Table B2.

Thereafter, in the fourth step, firing was performed at a peak temperature of 560° C. (peak temperature retention time 20 min) to remove the resin component in the second layer, which had served as the resist mask, thereby forming a thick layer pattern (a barrier) fixed to a glass substrate. Thus, samples 1 to 6 were prepared.

Evaluation results of the thick layer patterns (barriers) are summarized in the following Table B2.

TABLE B2

| Sample | Composition of 2nd layer: pattern-forming material for 2nd layer | Thickness (μm) | Resin component content (wt %) | Relative blast ratio | Evaluation results of thick layer pattern |
|---|---|---|---|---|---|
| 1 | I | 17 | 16.3 | 400 | Good |
| 2 | II | 15 | 14.3 | 350 | Good |
| 3 | III | 3 | 50 | 110 | Good |
| 4 | IV | 2.5 | 70 | 88 | Significantly ununiform |
| 5 | V | 16 | 5 | 120 | Good |
| 6 | VI | 14 | 4 | 90 | Significantly ununiform |

As is apparent from Table B2, for the samples which used a pattern-forming material, which provided a second layer with 5 to 95% by weight thereof being occupied by a resin component having a decomposition or volatilization temperature of 600° C. or below, and formed a second layer having a thickness of not less than 3 μm (samples 1 to 3 and 5), the blasting in the third step could be performed in a high relative blast ratio, and a good layer pattern (barrier) having an average line width in top of about 40 μm and a height of about 120 μm and possessing surface smoothness free from a break. Further, no breaking of the electrode pattern occurred.

By contrast, for sample 4, the thickness of the second layer was 2.5 μm, the relative blast ratio was as low as 88, and the thick layer pattern (barrier) was remarkably uniform. For sample 6 using pattern-forming material VI, which provides a resin component content in the second layer of 4% by weight, the relative blast ratio was 90, i.e., insufficient for the second layer to serve as a resist mask, and the thick layer pattern (barrier) was remarkably uniform.

As is apparent from the foregoing detailed description, according to the first embodiment wherein use is made of a pattern-forming material comprising a resin component, with a volatilization or decomposition temperature of 600° C. or below, in such an amount as will occupy 5 to 100% by weight after drying and optionally an inorganic powder having a melting point of 450 to 600° C., the pattern-forming material, by virtue of the resin component, has good etching resistance upon drying and can develop a function as a resist mask, and, in addition, the resin component can be removed in the step of firing, permitting the inorganic powder upon firing to be fused and remain unremoved.

In the method for thick layer pattern formation according to the second embodiment, which uses a material, for a first layer, comprising at least a resin component and an inorganic component, and the above pattern-forming material as a material for a second layer, after a pattern having a laminate structure of the first layer and the second layer is formed in the third step, the resin component is removed, in the fourth step as the step of firing, from the second layer, which has served as a resist mask in the third step, to form a thick layer pattern, and, at the same time, the inorganic powder contained in the second layer is fused to and integrated with the first layer. This enables the elimination of the step of separating and removing the resist mask by the wet method and, hence, simplifies the process and, in addition, makes it possible to use, as the first layer-forming material, a material which is easily etched and has low mechanical strength, resulting in reduced etching time, material, and energy. Further, a material, which is instable against an alkali and water but fusible at low temperatures, is usable as the inorganic component used in the first layer-forming material and the pattern-forming material, and a firing temperature (600° C. or below, for example, 300 to 600° C.) below the temperature used in the conventional thick layer pattern formation method is usable, preventing the deformation of the substrate and enabling the formation of a thick layer pattern having a minimized deviation in total pitch on a substrate having a large area. Further, since the use of a photographic process is unnecessary, a marked reduction in cost can be realized.

According to the third embodiment, a barrier defining the display discharge space rises steeply and perpendicularly to a glass substrate and, in addition, has a small width and a satisfactory height, realizing a plasma display panel having high brightness and high definition.

EXAMPLE C1

Figure 7A:
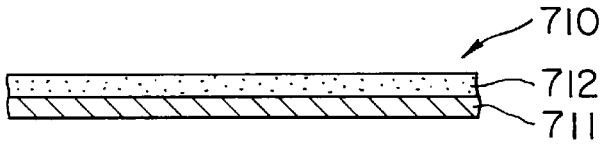

At the outset, as shown in FIG. 7A, a photosensitive, pressure-sensitive adhesive resin layer 712 was provided on a base film 711 to prepare a pressure-sensitive adhesive sheet 710. In this case, a pressure-sensitive adhesive resin was used which loses its tackiness upon exposure to ultraviolet light. Specifically, a pressure-sensitive adhesive resin having the following composition A was used and applied on a PET film (thickness 50 μm), and the coating was dried at 90° C. for 20 min to form a 20 μm-thick pressure-sensitive adhesive resin layer.

| <Composition A> | |
|---|---|
| Binder resin: "Hi-Pearl M-6664," manufactured by Negami Chemical Industrial Co., Ltd. | 40 parts |
| Diluent for reaction: | |
| (1) HEMA (hydroxyethyl methacrylate, manufactured by Shin-Nakamura Chemical Co., Ltd.) | 30 parts |
| (2) "A-TMPT-3E0," manufactured by Shin-Nakamura Chemical Co., Ltd. (EO-modified TMPTA (ethylene oxide-modified trimethylolpropane trimethacrylate)) | 30 parts |
| Solvent: 3-methoxybutyl acetate | 160 parts |
| Photopolymerization initiator: "Irgacure 651," manufactured by CIBA-GEIGY) | 6 parts |

Figure 7B:
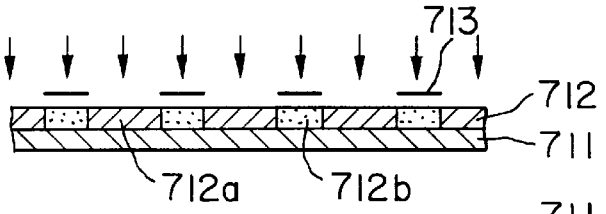

As shown in FIG. 7B, the pressure-sensitive adhesive layer 712 in the pressure-sensitive adhesive sheet 710 was subjected to pattern exposure to ultraviolet light through a mask 713. Upon the pattern exposure to the ultraviolet light, an exposed area was cured to form a cured area 712*a* which loses the tackiness, while the unexposed area remained unchanged as an uncured area 712*b*.

Figure 7C:
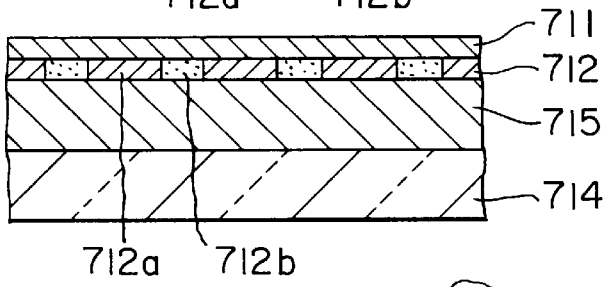
Figure 7D:
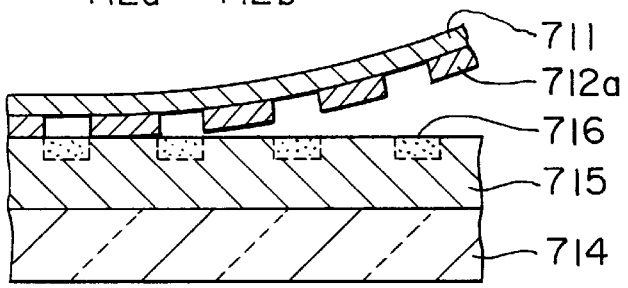

Separately, a paste for a barrier was coated on a glass substrate 714, and the coating was dried to provide a pattern-forming layer 715. As shown in FIG. 7C, the pressure-sensitive adhesive 710 was laminated onto the pattern-forming layer 715 so that the pressure-sensitive adhesive layer 712 faced the pattern-forming layer 715. The lamination in this way permitted the uncured area 712*b* in the pressure-sensitive resin layer 712 to penetrate into the upper part of the pattern-forming layer 715. Subsequently, as shown in FIG. 7D, upon the separation of the base film 711 from the pattern-forming layer 715, the cured area 712*a* in the pressure-sensitive adhesive resin layer 712 was removed to form a penetrated area 716 in the pattern-forming layer 715. Since this penetrated area 716 had tackiness, post-irradiation of the penetrated area 716 with ultraviolet light was performed to eliminate the tackiness.

Figure 7E:
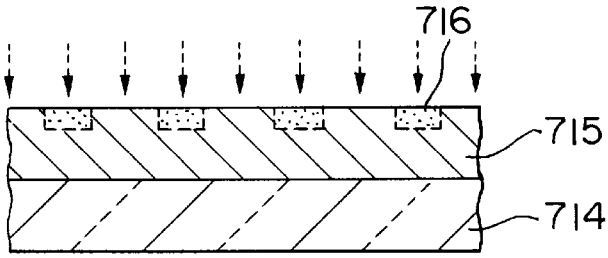
Figure 7F:
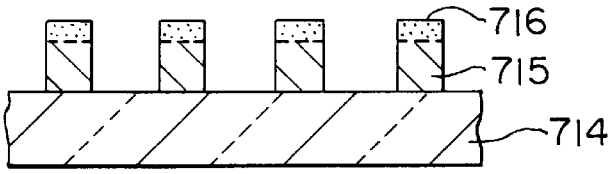
Figure 7G:
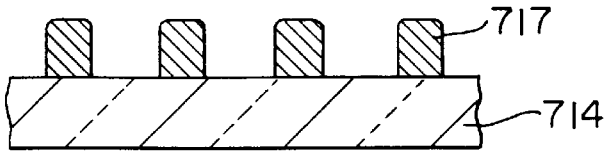

After the separation of the base film 711, sandblasting was performed as shown in FIG. 7E. In this case, as shown in FIG. 7F, the penetrated area 716 in the pattern-forming layer 715 was not cut out because it was in an elastic state by virtue of impregnation of the resin thereinto, while the pattern-forming material in the other area was removed. After the completion of the sandblasting, firing was performed wherein, as shown in FIG. 7G, the resin component in the penetrated area 716 was burned off, and, at the same time, a barrier-forming material was bound to the glass substrate 714 to form a barrier 717.

EXAMPLE C2

Figure 8A:
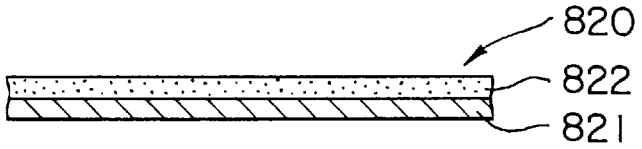

At the outset, as shown in FIG. 8A, a photosensitive resin layer 822 was provided on a base film 821 to prepare a photosensitive resin sheet 820. In this case, a photoadhesive primer layer was previously formed on the base film 821. Specifically, a photoadhesive resin having the following composition B was coated to form an about 10 μm-thick photoadhesive resin coating the whole area of which was cured by exposure to ultraviolet light to form a primer layer. Thereafter, a photosensitive resin having the following composition C was coated and laminated thereon, and the coating was then dried at 90° C. for 20 min to form a pressure-sensitive adhesive resin layer 822.

| <Composition B> | |
|---|---|
| "Aronix M-5700," manufactured by Toa Gosei Chemical Industry Co., Ltd. | 50 parts |
| "A-TMPT-3EO," manufactured by Shin-Nakamura Chemical Co., Ltd. (EO-modified TMPTA (ethylene oxide-modified trimethylolpropane trimethacrylate)) | 50 parts |
| **<Composition C>** | |
| Binder resin: methacrylate/styrene/acryl copolymer (50/20/30) | 50 parts |
| Diluent for reaction: (1) HEMA (hydroxyethyl methacrylate, manufactured by Shin-Nakamura Chemical Co., Ltd.) | 25 parts |
| (2) "A-TMPT-3EO," manufactured by Shin-Nakamura Chemical Co., Ltd. (EO-modified TMPTA (ethylene oxide-modified trimethylolpropane trimethacrylate)) | 25 parts |
| Solvent: 3-methoxybutyl acetate | 160 parts |

Figure 8B:
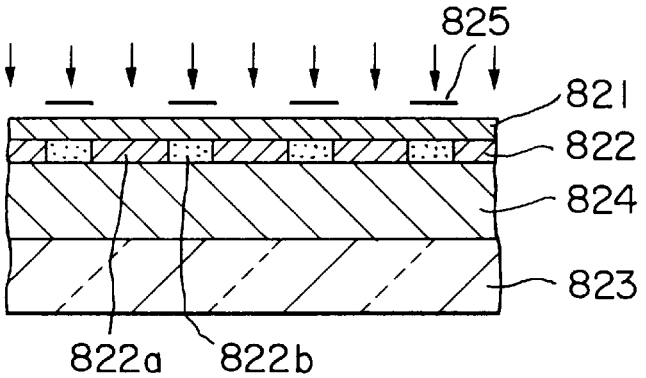

Thereafter, as shown in FIG. 8B, a paste, for a barrier, having the following composition was coated on a glass substrate 823, and the coating was dried to form a pattern-forming layer 824.

| | |
|---|---|
| Glass frit (MB-010, manufactured by Matsunami Garasu Kogyo | 65 parts by weight |
| α-Alumina RA-40 (manufactured by Iwatani Kagaku Kogyo) | 10 parts by weight |
| Daipyroxide Black #9510 (manufactured by Dainichiseika Color & Chemicals Manufacturing Co., Ltd.) | 10 parts by weight |
| Propylene glycol monomethyl ether | 20 parts by weight |
| Photosensitive resin (Details: | 20 parts by weight |
| Methyl methacrylate/methacrylic acid copolymer, acid value 100 mg KOH/g | 100 parts by weight |
| Polyoxyethylated trimethylolpropane triacrylate | 70 parts by weight |
| Photoinitiator ("Irgacure 907," manufactured by CIBA-GEIGY) | 10 parts by weight) |

Figure 8C:
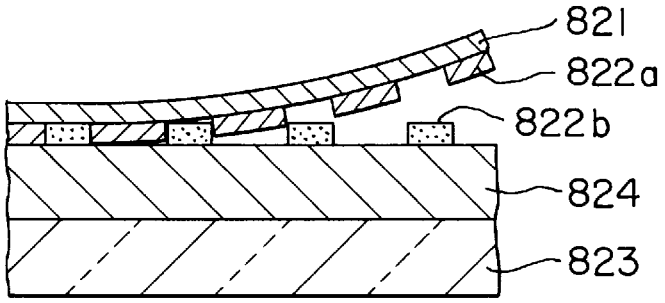

The photosensitive resin sheet 820 was put on the pattern-forming layer 824 so that the photosensitive resin layer 822 faced the pattern-forming layer 824, followed by heat lamination at a rate of 10 mm/sec by means of a hot roll at 80° C., and the photosensitive resin layer 822 in the photosensitive resin sheet 820 was subjected to pattern exposure to ultraviolet light through a mask 825. Upon the pattern exposure to the ultraviolet light, an exposed area was cured to form a cured area 822*a* which was adhered to a base film 821, while the unexposed area remained unchanged as an uncured area 822*b*. Subsequently, as shown in FIG. 8C, upon subsequent separation and removal of the base film 821 from the pattern-forming layer 824, the photosensitive resin 822 in its cured area 822*a* was removed, while the uncured area 822*b* was left on the pattern-forming layer 824.

Figure 8D:
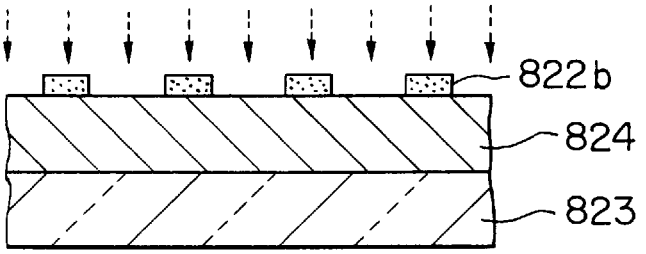
Figure 8E:
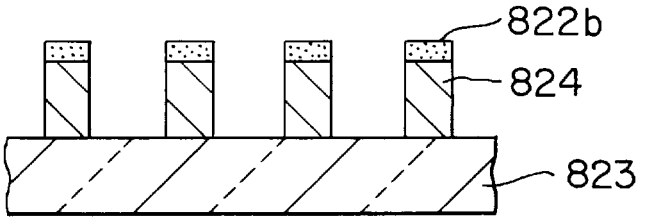
Figure 8F:
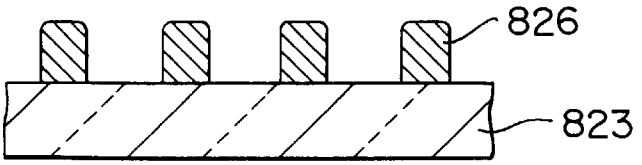

After the separation of the base film 811, sandblasting was performed as shown in FIG. 8D. In this case, as shown in FIG. 8E, the uncured area 822*b* in the photosensitive resin layer 822 was not cut out because it was in an elastic state, while the pattern-forming material in the other area was removed. After the completion of the sandblasting, firing was performed wherein, as shown in FIG. 8F, the uncured area 822*b* in the pressure-sensitive adhesive resin layer 822 was burned off, and, at the same time, a barrier-forming material was bound to the glass substrate 823 to form a barrier 826.

EXAMPLE C3

The procedure of Example C2 was repeated, except that a mask layer having the following composition was used instead of the composition C in Example C2.

| | |
|---|---|
| Glass frit (MB-008, manufactured by Matsunami Garasu Kogyo | 65 parts by weight |
| α-Alumina RA-40, (manufactured by Iwatani Kagaku Kogyo) | 10 parts by weight |
| Daipyroxide Black #9510 (manufactured by Dainichiseika Color & Chemicals Manufacturing Co., Ltd.) | 15 parts by weight |
| Polymethyl methacrylate | 10 parts by weight |
| Polyoxyethylated trimethylolpropane triacrylate | 12 parts by weight |
| Initiator (Irgacure 369, manufactured by CIBA-GEIGY) | 3 parts by weight |

The barrier-forming layer, together with the mask layer, was fired to form a barrier having a black barrier on a white barrier.

EXAMPLE C4

Figure 9A:
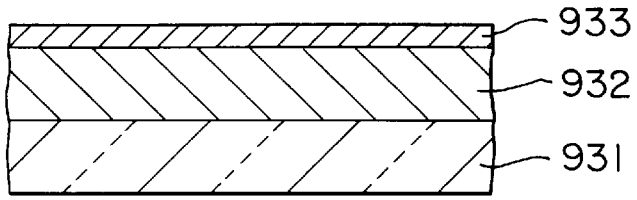

At the outset, as shown in FIG. 9A, a paste for a barrier was coated on a glass substrate 931, the coating was dried to provide a pattern-forming layer 932, and a photosensitive resin layer 933 was formed on the pattern-forming layer 932. Specifically, a photosensitive resin having the following composition D was coated on a PET film which had been treated for rendering the film releasable, and the coated PET film was laminated onto the pattern-forming layer 932 to transfer the coating onto the pattern-forming layer 932 to form a photosensitive resin layer 933.

| <Composition D> | |
|---|---|
| Binder resin: "Hi-Pearl M-6664," manufactured by Negami Chemical Industrial Co., Ltd. | 30 parts |
| Diluent for reaction: "A-TMPT-3EO," manufactured by Shin-Nakamura Chemical Co., Ltd. (EO-modified TMPTA (ethylene oxide-modified trimethylolpropane trimethacrylate)) | 70 parts |
| Photopolymerization initiator: "Irgacure 651," manufactured by CIBA-GEIGY) | 7 parts |

Figure 9B:
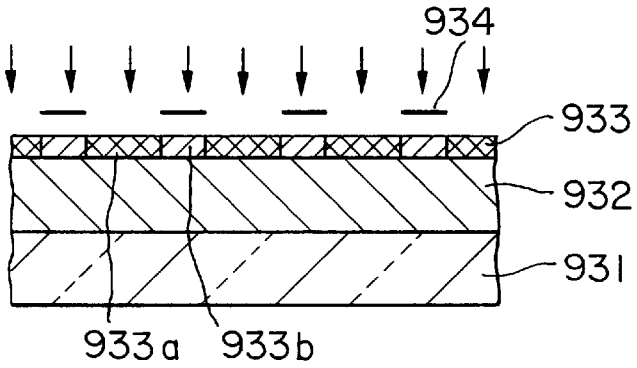
Figure 9C:
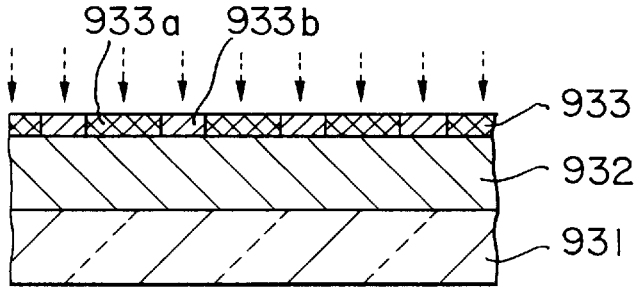
Figure 9D:
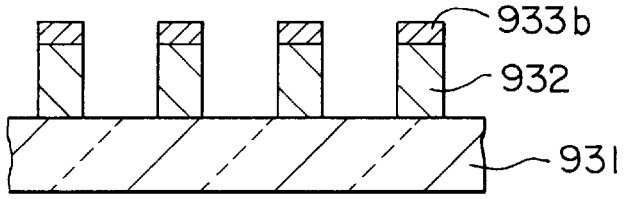
Figure 9E:
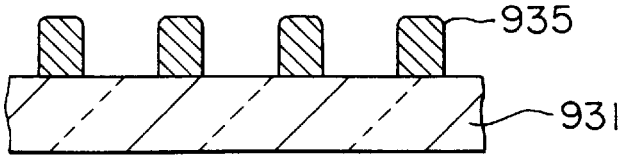

Subsequently, as shown in FIG. 9B, the photosensitive resin layer 933 was subjected to pattern exposure to ultraviolet light through a mask 934. Upon the pattern exposure to the ultraviolet light, an exposed area was brought to a brittle, high crosslinking density area 933*a*, while the unexposed area remained unchanged as an uncrosslinked area 933*b*. Sandblasting was then performed as shown in FIG. 9C. In this case, as shown in FIG. 9D, the uncrosslinked area 933b in the photosensitive resin layer 933 was not cut out because it was in an elastic state, whereas the high crosslinked area 933*a* was brittle and, hence, together with the underlying pattern-forming material, was removed. After the completion of the sandblasting, firing was performed wherein, as shown in FIG. 9E, the uncrosslinked area 933*b* in the photosensitive resin layer 933 was burned off, and, at the same time, a barrier-forming material was bound to the glass substrate 931 to form a barrier 935.

EXAMPLE C5

The procedure of Example C4 was repeated, except that a mask layer having the following composition was used instead of the composition D in Example C4. Firing of the barrier pattern, together with the mask pattern, resulted in the formation of a barrier composed of a white barrier having thereon a black barrier.

| | |
|---|---|
| Glass frit (MB-008, manufactured by Matsunami Garasu Kogyo | 65 parts by weight |
| α-Alumina RA-40, (manufactured by Iwatani Kagaku Kogyo) | 10 parts by weight |
| Daipyroxide Black #9510 (manufactured by Dainichiseika Color & Chemicals Manufacturing Co., Ltd.) | 15 parts by weight |
| Poly-n-butyl methacrylate | 10 parts by weight |
| Polyoxyethylated trimethylolpropane triacrylate | 5 parts by weight |
| Photoinitiator (Irgacure 369, manufactured by CIBA-GEIGY) | 3 parts by weight |

As described above, the process according to the present invention eliminates the need to provide the step of separating and removing the resist mask, simplifying the pattern formation process using sandblasting and enabling the use of a pattern-forming material which can be easily abraded and has low mechanical strength. Therefore, a damage to other constructions by the sandblasting can be reduced, the time required for the abrasion can be shortened, and the abrasive and the energy used can be saved.

Further, it is possible to use a glass powder, which is instable against an alkali or water, in the pattern-forming material, permitting firing at a lower temperature. This reduces the deformation of the glass substrate and enables a deviation in total pitch to be reduced to fall within an acceptable range even in the case of a large glass substrate.

EXAMPLE C6

This example demonstrates a process wherein an electrode, a dielectric layer, a barrier, and a mask layer for sandblasting are formed on a film and transferred at a time onto a substrate followed by sandblasting.

(Formation of patterned electrode-forming layer)

A material, for an electrode-forming layer, having the following composition was mixed and dispersed by means of a roll mill and then printed on a PET film using an intaglio to form a patterned electrode-forming layer having a line width of 50 μm, a pitch of 200 μm, and a layer thickness of 10±1 μm.

(Composition of electrode-forming layer)

Composition:

| | |
|---|---|
| Silver powder (average particle diameter 1 μm, spherical form) | 70 parts by weight |
| Glass frit {main components: $Bi_2O_3$, $SiO_2$, and $B_2O_3$, softening point 580° C., coefficient of thermal expansion $\alpha^{30}_{0} = 75 \times 10^{-7}$/°C.} | 5 parts by weight |
| Curable resin (Details: | 15 parts by weight |
| Polybutyl acrylate | 100 parts by weight |
| Polyoxyethylated trimethylolpropane | 60 parts by weight |

-continued

| | |
|---|---|
| triacrylate | |
| Photoinitiator ("Irgacure 369," manufactured by CIBA-GEIGY) | 10 parts by weight) |

(Formation of dielectric layer-forming layer)

A dielectric layer-forming layer having the following composition was formed on the electrode-forming layer.

The following ingredients:

| | |
|---|---|
| Glass frit {main components: $Bi_2O_3$, $ZnO_2$, and $B_2O_3$ (alkali-free) average patticle diameter 3 μm} | 70 parts by weight |
| $TiO_2$ | 3 parts by weight |
| $Al_2O_3$ | 7 parts by weight |

(Mixture of the above inorganic ingredients: softening point 570° C., Tg 485° C., coefficient of thermal expansion $\alpha_{300}=80\times10^{-7}/°$ C.)

| | |
|---|---|
| n-Butyl methacrylate/ hydroxyethylhexyl methacrylate copolymer (8/2) | 10 parts by weight |
| Benzyl butyl phthalate | 7 parts by weight |
| Isopropyl alcohol | 15 parts by weight |
| Methyl ethyl ketone | 5 parts by weight |

were mixed and dispersed with the aid of a beads mill, the dispersion was coated by Komma coating on the electrode layer, and the coating was dried at 100° C. to form a dielectric layer-forming layer having a thickness of 20±2 μm.

(Formation of barrier-forming layer)

A barrier-forming layer having the following composition was formed on the dielectric layer-forming layer.

The following ingredients:

| | |
|---|---|
| Glass frit (MB-008, manufactured by Matsunami Garasu Kogyo) | 65 parts by weight |
| α-Alumina RA-40, (manufactured by Iwatani Kagaku Kogyo) | 10 parts by weight |
| White pigment ($TiO_2$) | 10 parts by weight |
| Ethyl cellulose | 3 parts by weight |
| Propylene glycol monomethyl ether | 5 parts by weight |
| Isopropyl alcohol | 20 parts by weight |

were mixed and dispersed by means of a beads mill with the aid of ceramic beads, the dispersion was coated by die coating on the dielectric layer-forming layer, and the coating was dried at 120° C. to form a 180 μm-thick barrier-forming layer.

Further, a photosensitive black barrier-forming layer was formed on the above barrier-forming layer by the following method.

The following ingredients:

| | |
|---|---|
| Glass frit (MB-010, (manufactured by Matsunami Garasu Kogyo) | 65 parts by weight |
| α-Alumina RA-40, | 10 parts by weight |

-continued

| | |
|---|---|
| (manufactured by Iwatani Kagaku Kogyo) | |
| Daipyroxide Black #9510 (manufactured by Dainichiseika Color & Chemicals Manufacturing Co., Ltd.) | 10 parts by weight |
| Propylene glycol monomethyl ether | 20 parts by weight |
| Photosensitive resin (Details: | 20 parts by weight |
| Methyl methacrylate/ methacrylic acid copolymer, acid value 100 mg KOH/g | 100 parts by weight |
| Polyoxyethylated trimethylolpropane triacrylate | 70 parts by weight |
| Photoinitiator ("Irgacure 907," manufactured by CIBA-GEIGY) | 10 parts by weight) |

were kneaded and dispersed by means of a three-roll mill, the dispersion was coated by Komma coating, and the coating was dried at 100° C. to form a 30 μm-thick photosensitive black barrier-forming layer. A PET film was applied thereon to form a transfer sheet for PDP.

This transfer sheet was a laminate of a PET film having thereon, in the following order, a photosensitive black barrier-forming layer (thickness 30 μm), a barrier-forming layer (thickness 180 μm), a dielectric layer forming layer (thickness 20±2 μm), a patterned electrode-forming layer (thickness 10 μm), and a PET film.

After the separation of the PET film on the patterned electrode-forming layer side of the transfer sheet, the transfer sheet was then laminated onto a PDP panel member composed of a glass substrate bearing a primer layer by means of a hot roll using an autocut laminator (model ACL-900, manufactured by Asahi Chemical Industry Co., Ltd.) under conditions of preheating temperature 60° C. and lamination roll temperature 120° C.

Thereafter, a line pattern mask having a line width of 80 μm and a pitch of 220 μm was registered and disposed on the photosensitive black barrier-forming layer through a PET film. Ultraviolet light (365 nm, dose 500 mJ/cm$^2$) was then applied, and spray development was performed with an aqueous 1 wt% sodium carbonate solution. Thus, a photosensitive black barrier-forming layer pattern corresponding to the line pattern mask was formed. Subsequently, the barrier-forming layer was sandblasted using this pattern as a mask. The photosensitive black barrier-forming layer and the dielectric layer-forming layer were inspected. As a result, no influence of the sandblasting was found.

The resultant PDP panel member was fired at a peak temperature of 570° C. to simutaneously form an electrode layer, a dielectric layer, and a barrier layer. The thickness of the electrode layer was 6±1 μm, the thickness of the dielectric layer was 20 μm, and the barrier layer had a line width of 50 μm and a height of 120 μm. The barrier layer had uniform height and excellent surface smoothness, and no defect was found in any barrier layer.

We claim:

1. A process for producing a plasma display panel, involving the formation of a predetermined pattern, for a plasma display panel, including an electrode pattern and a barrier for defining a discharge space, said process comprising the steps of:

forming a predetermined pattern-forming material layer on a substrate;

forming a mask pattern, comprising a main component of the pattern-forming material layer, on the pattern-forming material layer:

etching the pattern-forming material layer with the mask pattern formed thereon, thereby patterning the pattern-forming material layer; and then firing the pattern-forming material layer with the mask pattern provided thereon and the mask layer, thereby integrating the pattern-forming material layer and at least part of the mask layer with each other.

2. The process according to claim 1, wherein the predetermined pattern is a barrier pattern.

3. The process according to claim 1, wherein the etching is sandblasting.

4. The process according to claim 1, wherein the material for a mask pattern further comprises an ionizing radiation curing resin and a material layer for the mask is patterned by photolithography to form the mask pattern.

5. The process according to claim 4, wherein the first barrier-forming material further comprises a pigment having a bright color.

6. The process according to claim 1, which comprises the steps of:

coating a first material, for a barrier, comprising at least a low-melting glass frit and a binder resin on the inner surface of one of two parallel opposed insulating substrates and drying the coating, this step being conducted once or repeated a plurality of times, thereby forming a first barrier-forming material layer having a required height;

coating a second barrier-forming material comprising at least a low-melting glass frit and an ultraviolet-curable resin, the proportion of the ultraviolet-curable resin being larger than that of the binder resin in the first barrier-forming material, on the first barrier-forming material layer, to a required height and drying the coating to form a second barrier-forming material layer;

applying ultraviolet light through a photomask to the second barrier-forming material layer in its areas where a barrier pattern is to be formed, and developing the exposed second barrier-forming material layer to form a barrier pattern;

cutting the first barrier-forming material layer by sandblasting using as an anti-sandblast mask the second barrier-forming material layer with a barrier pattern formed thereon; and firing the first barrier-forming material layer and the second barrier-forming material layer to form a barrier composed of a first barrier layer and a second barrier layer.

7. The process according to claim 6, wherein the second barrier-forming material further comprises a pigment having a dark color.

8. The process according to claim 1, wherein the content of the ultraviolet-curable resin is 5 to 150 parts by weight based on 100 parts by weight of the low-melting glass frit in the second barrier-forming material and the content of the binder resin is 0.5 to 4% by weight based on 100 parts by weight of the low-melting glass frit in the first barrier-forming material.

9. The process according to claim 6, wherein the second barrier-forming material is permeable to light.

10. The process according to claim 1, which comprises the steps of:

coating a first barrier-forming material comprising at least a low-melting glass frit and a binder resin on the inner surface of one of two parallel opposed insulating substrates and drying the coating, this step being conducted once or repeated a plurality of times, thereby forming a first barrier-forming material layer having a required height;

coating a third barrier-forming material comprising at least a low-melting glass frit and a binder resin on the first barrier-forming material layer to a required height and drying the coating to form a third barrier-forming material layer;

coating a second barrier-forming material comprising at least a low-melting glass frit and an ultraviolet-curable resin, the proportion of the ultraviolet-curable resin being larger than that of the binder resin in the first barrier-forming material, on the third barrier-forming material layer to a required height and drying the coating to form a second barrier-forming material layer;

applying ultraviolet light through a photomask to the second barrier-forming material layer in its areas where a barrier pattern is to be formed, and developing the exposed second barrier-forming material layer to form a barrier pattern;

cutting the first barrier-forming material layer and the third barrier-forming material layer by sandblasting using as an anti-sandblast mask the second barrier-forming material layer having a barrier pattern; and firing the first barrier-forming material layer, the third barrier-forming material layer, and the second barrier-forming material layer to form a barrier composed of a first barrier layer, a third barrier layer, and a second barrier layer.

11. The process according to claim 10, wherein the content of the ultraviolet-curable resin is 5 to 150 parts by weight based on 100 parts by weight of the low-melting glass frit in the second barrier-forming material and the content of the binder resin is 0.5 to 4% by weight based on 100 parts by weight of the low-melting glass frit in the first barrier-forming material.

12. The process according to claim 10, wherein the first barrier-forming material further comprises a pigment having a bright color.

13. The process according to claim 10, wherein the second barrier-forming material further comprises a pigment having a dark color.

14. The process according to claim 10, wherein the second barrier-forming material is permeable to light.

15. The process according to claim 10, wherein the third barrier-forming material further comprises a pigment having a dark color.

16. The process according to claim 10, wherein the percentage heat shrinkage on firing of the third barrier-forming material is intermediate between the percentage heat shrinkage on firing of the first barrier-forming material and the percentage heat shrinkage on firing of the second barrier-forming material.

17. A plasma display panel comprising a barrier for defining a discharge space, said barrier being provided on the inner surface of one of two parallel opposed insulting substrates, wherein the barrier comprises a laminate of first, second, and third layers each formed of a sinter composed mainly of a low-melting glass, the first layer provided on the insulating substrate side is colored with a bright color pigment, the third layer provided between the first layer and the second layer is colored with a dark color pigment and the second layer as a surface layer through which light emerges is permeable to light.

18. The process according to claim 1, wherein mask pattern is formed by printing.

19. The process according to claim 18, which comprises:

the first step of using a first layer-forming material comprising at least a resin component and an inorganic component to form a first layer, with the content of the resin component being 0.5 to 4% by weight, on a substrate;

the second step of forming a second layer, having a predetermined pattern, formed of a pattering-forming material as a second layer-forming material on the first layer by printing, the pattern-forming material comprising at least a low-melting glass frit and a resin component, the content of the resin component being 5 to 100 parts by weight based on the solid content;

the third step of removing the first layer in its exposed area by etching using the second layer as an anti-etching mask to form a pattern having a laminate structure of the first layer and the second layer; and the fourth step of firing the pattern at 500 to 600° C. to form a thick layer pattern and, at the same time, to fix the thick layer pattern to the substrate.

20. The process according to claim 19, wherein the material for a second layer has a dynamic viscosity coefficient of 500 to 4000 poises.

21. The process according to claim 19, wherein the etching in the third step is sandblasting.

22. The process according to claim 19, wherein the printing in the second step is intaglio offset printing through an intermediate transfer medium.

23. The process according to claim 22, wherein the intermediate transfer medium at least in its outermost surface is formed of a silicone resin composed mainly of dimethylsiloxane units and, in the transfer of the material for a second layer onto the first layer to form the second layer, the percentage transfer of the material for a second layer is 100%.

24. The process according to claim 23, wherein the intaglio used in the intaglio offset printing has a depression depth of 10 to 50 $\mu$m.

25. The process according to claim 19, wherein the printing in the second step is screen printing.

26. The process according to claim 19, wherein the thickness of the second layer after drying is 3 to 50 $\mu$m.

27. The process according to claim 1, wherein the mask pattern is formed by a process comprising the steps of:

(a) providing a sheet comprising a base film bearing a layer containing a photosensitive resin;

(b) subjecting the resin-containing layer to pattern exposure in a mask pattern form to form a cured area and an uncured area in the resin-containing layer;

(c) laminating the sheet onto the material layer for a pattern so as for the resin-containing layer side to face the pattern-forming material layer, thereby permitting the resin-containing layer in its uncured area alone to penetrate into the surface of the pattern-forming material layer; and (d) separating the base film from the pattern-forming material layer to remove the resin-containing layer in its cured area alone, thereby forming a mask pattern on the pattern-forming material layer.

28. The process according to claim 27, which further comprises the steps of:

etching the pattern-forming material layer, with the mask pattern formed thereon by sandblasting, thereby patterning the pattern-forming material layer; and then firing the pattern-forming material layer with the mask pattern provided thereon and the mask layer, thereby integrating the pattern-forming material layer and at least part of the mask layer with each other.

29. The process according to claim 1, wherein the mask pattern is formed by a process comprising the steps of:

(a) providing a mask sheet comprising a base film bearing a photosensitive mask layer;

(b) laminating the mask sheet onto the pattern-forming material layer so as for the mask layer side to face the pattern-forming material layer;

(c) subjecting the mask layer to pattern exposure in a mask pattern form to form a cured area and an uncured area in the mask layer; and (d) separating the base film from the pattern-forming material layer to remove the said adhesive resin layer in its cured area alone, thereby forming a mask pattern on the pattern-forming material layer.

30. The process according to claim 29, which further comprises the steps of:

etching the pattern-forming material layer with the mask pattern formed thereon by sandblasting, thereby patterning the pattern-forming material layer; and then firing the pattern-forming material layer with the mask pattern provided thereon and the mask layer, thereby integrating the pattern-forming material layer and at least part of the mask layer with each other.

31. The process according to claim 1, wherein the mask pattern is formed by a process comprising the steps of:

(a) forming a photosensitive mask layer on the pattern-forming material layer; and (b) subjecting the mask layer to pattern exposure in a mask pattern form to form a mask pattern comprising (i) a hard, brittle high crosslinked portion and (ii) a soft uncrosslinked portion.

32. The process according to claim 31, which further comprises the steps of:

etching the high crosslinked portion in the mask layer and the underlying pattern-forming material layer by sandblasting to pattern the pattern-forming material layer; and firing the pattern-forming material layer and the mask layer with the uncrosslinked portion remaining unremoved to burn off the resin component in the mask layer and, at the same time, to integrate the pattern-forming material layer and at least part of the mask layer with each other.

* * * * *